US008089215B2

(12) United States Patent
Tanaka et al.

(10) Patent No.: US 8,089,215 B2
(45) Date of Patent: Jan. 3, 2012

(54) DISCHARGE LAMP LIGHTING DEVICE, HEADLIGHT DEVICE AND VEHICLE HAVING THE SAME

(75) Inventors: Toshifumi Tanaka, Toyonaka (JP); Hirofumi Konishi, Hirakata (JP); Shin Ukegawa, Kyotanabe (JP); Shinichi Anami, Hirakata (JP); Masahiro Seki, Sanjo (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 367 days.

(21) Appl. No.: 12/461,750

(22) Filed: Aug. 24, 2009

(65) Prior Publication Data

US 2010/0052538 A1 Mar. 4, 2010

(30) Foreign Application Priority Data

Aug. 26, 2008 (JP) ..... 2008-217374
Aug. 26, 2008 (JP) ..... 2008-217413

(51) Int. Cl.
*H05B 37/02* (2006.01)

(52) U.S. Cl. ..... 315/291; 315/307; 315/247; 315/276

(58) Field of Classification Search ..... 315/76–77, 315/82, 209 R, 224–225, 237, 268, 291, 307–311, 315/326, 352, DIG. 7
See application file for complete search history.

(56) References Cited

U.S. PATENT DOCUMENTS 6,504,323 B2 * 1/2003 Yuda et al. ..... 315/307
7,208,882 B2 * 4/2007 Ishizuka ..... 315/225
2011/0043771 A1 * 2/2011 Hirao ..... 353/85

* cited by examiner

*Primary Examiner* — Shawki S Ismail
*Assistant Examiner* — Jany Tran
(74) *Attorney, Agent, or Firm* — Bacon & Thomas, PLLC

(57) ABSTRACT

A discharge lamp lighting device includes: a DC power source; an inverter for inverting the DC power at a predetermined inversion time interval to supply a square wave AC power to a discharge lamp; and a controller for controlling the output power. The controller performs a synchronous operation and controls the DC power source such that DC power outputted during a period other than the output temporarily increasing period in a power increasing period is greater than the DC output power outputted during the period other than the output temporarily increasing period in a rated power period. Further, the controller controls the DC power source such that at least one of an increment of the output power for the output temporarily increasing period and a length of the output temporarily increasing period is less in at least a part of the output increasing period than in the rated power period.

16 Claims, 28 Drawing Sheets

DISCHARGE LAMP LIGHTING DEVICE, HEADLIGHT DEVICE AND VEHICLE HAVING THE SAME

FIELD OF THE INVENTION

The present invention relates to a discharge lamp lighting device, a headlight device and a vehicle equipped with same.

BACKGROUND OF THE INVENTION

Traditionally, a discharge lamp lighting device for lighting high pressure discharge lamps such as metal halide lamps or the like. Such a discharge lamp lighting device employs a square wave lighting technique to avoid an acoustic resonance phenomenon and has been used for lighting the light sources of, e.g., a spotlight, a projector and the headlight device of a vehicle.

This kind of discharge lamp lighting device has a DC power source which outputs a DC power, and an inverter which inverts the polarity of the DC power outputted from the DC power source at a predetermined inversion time interval to thereby obtain a square wave AC power and then supplies the square wave AC power to a discharge lamp.

In the above discharge lamp lighting device, when the polarity of the output from the inverter is inverted (hereinafter, referred to simply as "inversion"), the temperature of an electrode of the discharge lamp drops as the output current from the inverter to the discharge lamp is temporarily decreased to thereby make the discharge of the discharge lamp after inversion instable, thus causing flickering or extinction of the discharge lamp or generating electronic noises.

To prevent such problems, e.g., Japanese Patent Laid-open Application Nos. H10-501919 and 2002-110392 discloses a technique of temporarily increasing the output power from the inverter (hereinafter, referred to simply as "output power") right before or after the inversion. If the output power is increased right before inversion as described in H10-501919, the temperature drop in a discharge lamp is constrained. Also, as described in 2002-110392, an increase in the output power right after inversion contributes to a quick temperature recovery after the temperature drop in an electrode of the discharge lamp. In this way, discharge in the discharge lamp becomes stable, and thus the flickering or the extinction of the discharge lamp, or the electronic noises can be constrained.

However, if the average value in one period of the output power is set too high, electrical stress upon the discharge lamp increases to thereby shorten the life span of the discharge lamp.

SUMMARY OF THE INVENTION

In view of the above, the present invention provides a discharge lamp lighting device which can minimize flickering and extinction phenomenon of the discharge lamp and reduce electronic noises while constraining electrical stress on the discharge lamp; a headlight device having the discharge lamp lighting device; and a vehicle equipped with the headlight device.

In accordance with a first aspect of the present invention, there is provided a discharge lamp lighting device, including: a DC power source for outputting a DC output power; an inverter for inverting the DC power outputted from the DC power source at a predetermined inversion time interval to supply a square wave AC power to a discharge lamp; and a controller for controlling the output power from the DC power source, wherein the controller performs a synchronous operation for temporarily increasing the output power from the DC power source in an output temporarily increasing period existing immediately before and/or immediately after every inversion operation of the inverter, wherein the controller controls the DC power source such that DC power outputted during a period other than the output temporarily increasing period in a power increasing period is greater than the DC output power outputted during the period other than the output temporarily increasing period in a rated power period, the rated power period being a period during which a rated power is supplied to the discharge lamp and the power increasing period being a period from start-up of the discharge lamp to an onset of the rated power period, and wherein the controller controls the DC power source such that at least one of an increment of the output power for the output temporarily increasing period and a length of the output temporarily increasing period is less in at least a part of the output increasing period than in the rated power period.

In accordance with a second aspect of the present invention, there is provided a headlight device, including a discharge lamp lighting device described above, and a discharge lamp lighted by the discharge lamp lighting device.

In accordance with a third aspect of the present invention, there is provided a vehicle, including the headlight device described above.

In accordance with the present invention, electrical stress upon the circuit components or the discharge lamp in the post-inversion period or in the pre-inversion period is restrained.

BRIEF DESCRIPTION OF THE DRAWINGS

The objects and features of the present invention will become apparent from the following description of preferred embodiments, given in conjunction with the accompanying drawings, in which:

FIGS. 8A and 8B are explanatory views of the waveforms of the lamp current in the second embodiment, in which FIG. 8A shows a state where the elapsed time is 4 sec, and FIG. 8B shows a state where the elapsed time is 50 sec;

FIG. 16A shows a state where the elapsed time is 4 sec, and FIG. 16B shows a state where the elapsed time is 50 sec;

FIG. 18A shows a state where the elapsed time is 4 sec, and FIG. 18B shows a state where the elapsed time is 50 sec;

FIG. 27A shows a state where the elapsed time is 4 sec, and FIG. 27B shows a state where the elapsed time is 50 sec;

FIG. 40A shows a state where the elapsed time is 4 sec, and FIG. 40B shows a state where the elapsed time is 50 sec.

DETAILED DESCRIPTION OF THE EMBODIMENTS

Hereinafter, embodiments of the present invention will be described in detail with reference to the accompanying drawings which form a part hereof.

First Embodiment

Figure 1A:
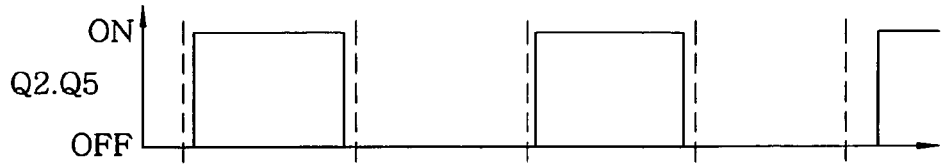
FIGS. 1A to 1E are explanatory views of an operation of a first embodiment in accordance with the present invention.
Figure 1B:
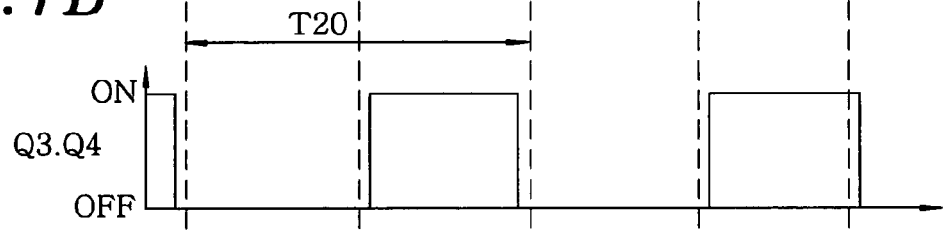
Figure 1C:
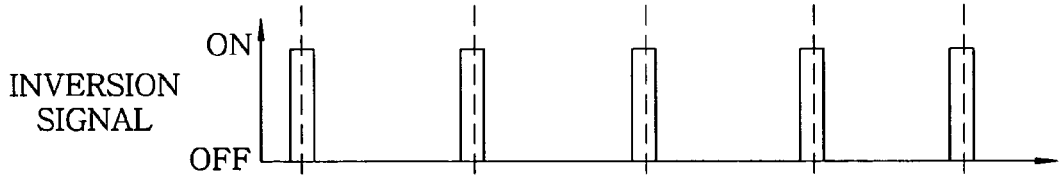
Figure 1D:
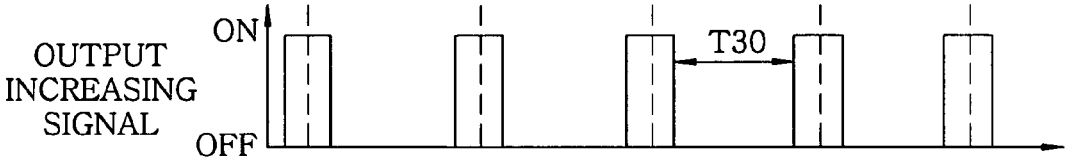
Figure 1E:
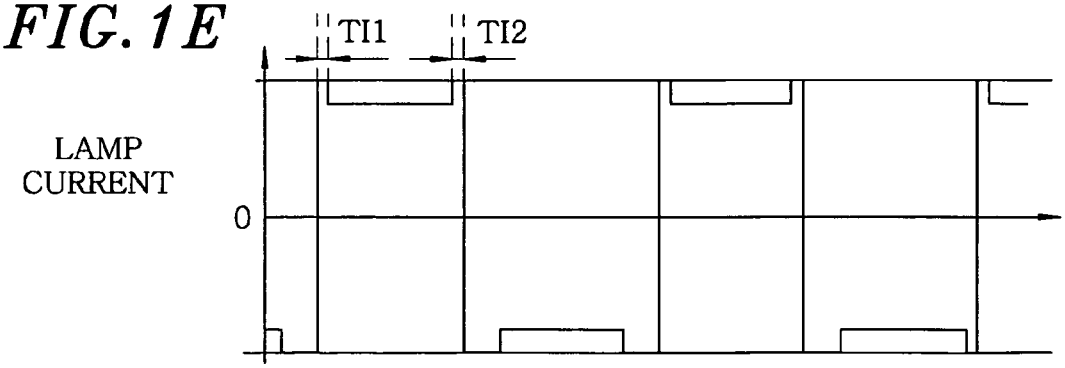
Figure 2:
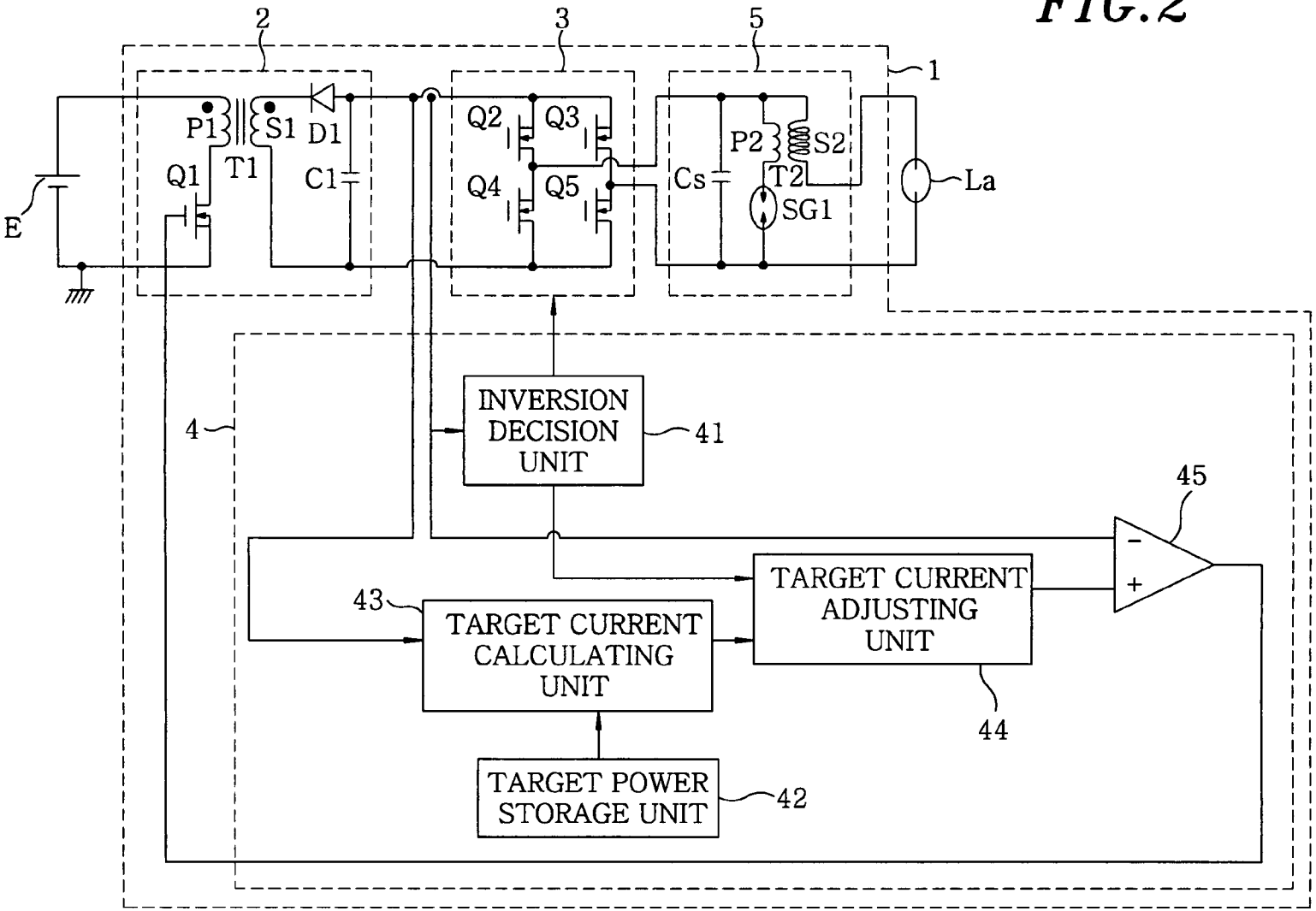
FIG. 2 is a circuit block diagram of the first embodiment.

A discharge lamp lighting device 1 of this embodiment as shown in FIG. 2 includes a DC/DC converter 2 which serves as a DC power source for converting a voltage value of the DC power that is inputted from a DC power source E; an inverter 3 for alternating the polarity of the DC power that is outputted from the DC/DC converter 2 to output it to a discharge lamp La; and a controller 4 for controlling the DC/DC converter 2 and the inverter 3. Further, an igniter 5 is provided between the inverter 3 and the discharge lamp La to generate a high voltage for the start-up of the discharge lamp La.

To explain in detail, an output end on a low voltage side of the DC power source E is connected to ground, and the DC/DC converter 2 is a known flyback converter, which includes a transformer T1 having a primary coil P1 with one end connected to an output end on the high voltage side of the DC power source E while the other end is connected to the ground via a switching element Q1; an output capacitor C1 having one end connected to the ground; and a diode D1 having an anode connected to the other end of the output capacitor C1 and a cathode connected to the ground via a secondary coil S1 of the transformer T1, wherein both ends of the output capacitor C1 are output ends of the DC/DC converter. The controller 4 outputs a control signal, which is a PWM (pulse width modulation) signal, for turning on and off the switching element Q1 of the DC/DC converter 2, to control output power from the DC/DC converter 2.

Further, the inverter 3 is a full bridge type inverter circuit including two series circuits, i.e., one series circuit of two switching elements Q2 and Q4, and the other of two switching elements Q3 and Q5, connected in parallel between the output ends of the DC/DC converter 2, wherein the nodes between the series Q2/Q4 and Q3/Q5 serve as output ends of the inverter 3. As the two switching elements of the each series circuit, i.e., Q2/Q4 and Q3/Q5 are turned on and off alternately and the diagonally disposed switching elements, i.e., Q2/Q5 and Q3/Q4 are turned on and off simultaneously, the inverter 3 converts the output DC power from the DC/DC converter 2 into a square wave AC power to output same.

The igniter 5 includes a capacitor Cs connected between the output ends of the inverter 3, and a transformer T2 whose one end of each of primary and secondary coils P2 and S2 are connected to one output end of the inverter 3. The other end of the primary coil P2 is connected to the other output end of the inverter 3 via a spark gap SG1, and the other end of the secondary coil S2 is connected to the other output end of the inverter 3 via the discharge lamp La.

The controller 4 includes an inversion decision unit 41 for controlling the inverter 3; a target power storage unit 42 for storing a target power value of the output power from the DC/DC converter 2 (i.e., the output power from the inverter 3 to the discharge lamp La, hereinafter, it will be referred to simply as "output power"); and a target current calculating unit 43 for detecting an output voltage from the DC/DC converter 2, and calculating a target current value of the output current from the DC/DC converter 2 based on the detected output voltage (hereinafter, it will be referred to as a "voltage detection value") and the target power value stored in the target power storage unit 42.

The controller 4 further includes a target current adjusting unit 44 which normally generates an adjusted target current value not greater than the target current value outputted from the target current calculating unit 43 but, during a predetermined period before and after the inverter 3 inverts the polarity of its output, generates an adjusted target current value not smaller than the target current value from the target current calculating unit 43; and a control signal generating unit 45 for detecting an output current from the DC/DC converter 2, to generate a control signal for controlling the DC/DC converter 2 such that the detected output current (hereinafter, it will be referred as a "current detection value") approximates the adjusted target current value outputted from the target current adjusting unit 44. Detailed description on the controller 4 will be omitted here since it can be realized by known technique.

Specifically, the inverter 3 includes a driving unit (not shown) for turning on and off each of the switching elements Q2 to Q5. As shown in FIG. 1, the inversion decision unit 41 of the controller 4 inputs square waveform inversion signals to the inverter 3. In a period when no inversion signal is outputted (i.e., in a period when the output of the inversion decision unit 41 is at an L level), the driving unit of the inverter 3 turns on one of a pair of the diagonally disposed switching elements Q2 and Q5 (hereinafter, they will be referred to as "first switching elements")and another pair of the diagonally disposed switching elements Q3 and Q4 (hereinafter, they will be referred to as "second switching elements") and turns off the other pair.

Moreover, in a period when an inversion signal is being outputted (i.e., a period when the output of the inversion decision unit 41 is at an H level), the driving unit turns off all the switching elements of Q2 to Q5, and when the output of an inversion signal is terminated (i.e., when the output of the inversion decision unit 41 is changed to the L level again), the driving unit inverts the ON/OFF state of each of the switching elements Q2 to Q5 with respect to the state before the previous inversion signal is inputted. That is, the output of the inverter 3 is inverted after supplying an inversion signal from the controller 4 to the inverter 3, and the frequency of the output of the inverter 3 corresponds to one half of the frequency of the inversion signal.

Further, the inversion decision unit 41 decides a lighting state of the discharge lamp La based on, for example, the current detection value, and maintains the inversion signal at the L level during a time period when the inversion decision unit 41 decides that the discharge lamp La is turned off. In other words, until the discharge lamp La is lighted after the power is supplied, the first switching elements Q2 and Q5 maintain the ON state, and the second switching elements Q3 and Q4 maintain the OFF state. Then, with an increase in the output voltage from the DC/DC converter 2, the amplitude of an output voltage from the inverter 3 gradually increases, and thus voltages at both ends of the spark gap SG1 increase gradually.

After a while, if breakdown occurs in the spark gap SG1, the current flowing in the primary coil P2 of the transformer T2 experiences a sharp increase, which in turn generates an induced electromotive force to the secondary coil S2 of the transformer T2. By a high voltage of, for example, several tens of kV, which is an overlapped voltage of a voltage from the induced electromotive force and an output voltage from the inverter 3, an arc discharge is initiated in the discharge lamp La (i.e., the discharge lamp La starts up and is lighted). After that, the inversion signal start to be outputted from the inversion decision unit 41 which has decided determined that the discharge lamp La was turned on, thus initiating output of square wave AC power by the inverter circuit 3.

Figure 3:
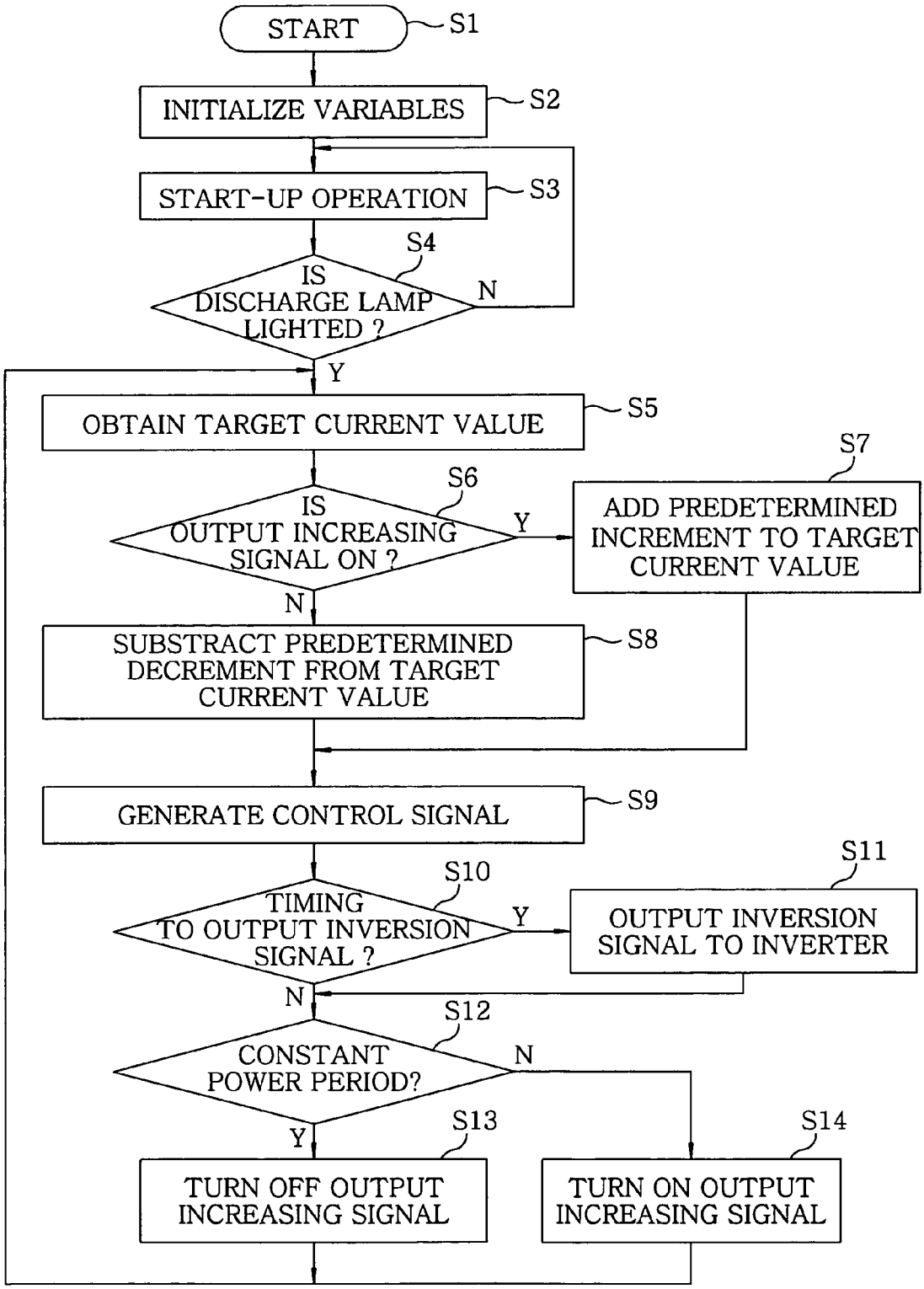
FIG. 3 is a flow chart describing an operation of the first embodiment.

An operation of this embodiment will now be explained with reference to FIG. 3. First, an operation starts in step S1 when power is supplied, and various variables to be used for the operation of the unit of the controller 4 are initialized in step S2, followed by the initiation of a start-up operation in the inverter 3 in step S3 as the inversion decision unit 41 does not output an inversion signal. That is, only two switching elements Q2 and Q5 that are diagonally disposed in the inverter 3 are turned ON in step S3, so that the discharge lamp La is started-up by the igniter 5. Next, the inversion decision unit 41 decides whether or not the discharge lamp La is lighted in step S4; and if it is decided that the discharge lamp La is not lighted, the start-up operation in step S3 is continued.

Meanwhile, if it is decided that the discharge lamp La is lighted in step S4, the process proceeds to the step S5, in which the inverter 3 starts outputting the square wave AC power to the discharge lamp La. In step S5, the target current calculating unit 43 detects the output voltage from the DC/DC converter 2 to obtain the voltage detection value.

The target current calculating unit 43 stores, e.g., three most recently acquired voltage detection values, and averages four voltage detection values including a newly obtained voltage detection value and the stored three voltage detection values to get an average voltage value for use in the control. Thereafter, the oldest one among the three stored voltage detection values is updated with the newly obtained one by using thus obtained average voltage value of the plural voltage detection values in control, the influence of noise can be suppressed.

Further, the controller 4 includes a counter unit (not shown) for counting elapsed time after it is decided in step S4 that the discharge lamp La is lighted (hereinafter, it will be referred to simply as "elapsed time"), and the target current calculating unit 43 reads out from the target power storage unit 42 a target power value according to the elapsed time counted by the counting unit. Here, the target power storage unit 42 stores target power values as a function of elapsed time, for example, in a data table form. For instance, as shown in FIG.

4, the target power value is set to 75 W when the elapsed time ranges from 0 to 4 sec and gradually drops to 34 W with a decreasing dropping rate when the elapsed time ranges from 4 to 50 sec, and stays at 34 W when the elapsed time is longer than 50 sec. That is, the normal operation for maintaining the target power value at a rated power of 34 W is performed in a rated power period after the elapsed time reaches 50 sec, while an output increasing operation for increasing the target power value to a value higher than the rated power is performed in a time period until the normal operation is initiated (hereinafter, it will be referred to as an "output (or power) increasing period"). Also, since change in the target power value against the elapsed time is much slower compared with the output period of the inverter 3, it can be regarded that the target power value during the one output period of the inverter 3 is virtually constant.

Because the temperature of the discharge lamp La increases quickly through the output increasing operation carried out at the initial stage of lighting the discharge lamp La as described above, the light output of the discharge lamp La can be stabilized within a shorter amount of time as compared with a case where no output increasing operation is done. The constant normal power is called a rated power of the discharge lamp La, e.g., required to be supplied thereto after the operation of the discharge lamp lighting device 1 shown in FIG. 2 is stabilized. The target current calculating unit 43 obtains a target current value by dividing a target power value read from the target power storage unit 42 according to elapsed time by the average voltage value and outputs the thus obtained target current value to the target current adjusting unit 44.

Further, the inversion decision unit 41 decides timing to output an inversion signal to the inverter 3, based on the elapsed time counted by the counter unit, and provides to the target power adjusting unit 44 an output increasing signal (i.e., turning ON the output increasing signal) for temporarily increasing the output power of the DC/DC converter 2. The output increasing signal is on from the start-up of a predetermined pre-inversion period TI2 existing right before the start-up of the output of an inversion signal to the end of a predetermined post-inversion period T11 existing right after ending the output of the inversion signal.

When a target current value is inputted from the target current calculating unit 43, the target current adjusting unit 44 decides whether the output increasing signal is ON or not in step S6. If the output increasing signal is ON, the target current adjusting unit 44 outputs to the control signal generating unit 45 a first updated target current value that is obtained by adding a predetermined increment to the target current value inputted from the target current calculating unit 43 in step S7. If the output increasing signal is OFF, the target current adjusting unit 44 outputs to the control signal generating unit 45 a second updated target current value that is obtained by subtracting a predetermined decrement from the target current value inputted from the target current calculating unit 43.

The increment is about 0.1 to 1 times the rated current value of the discharge lamp La. For instance, if the rated current value is 0.4 A, the increment is set to 0.04 A to 0.4 A, and if a rated current value is 0.8 A, the increment is set to 0.08 A to 0.8 A. The decrement is a value properly selected to maintain an average current of the discharge lamp La to be equal to the target current inputted from the target current calculating unit 43.

The control signal generating unit 45 detects an output current of the DC/DC converter 2 to obtain a current detection value. The control signal generating unit 45 also stores, e.g., three most recently acquired current detection values including the newest and following three most recently obtained ones and updates them whenever necessary, and averages four current detection values including the newly obtained current detection value and the stored three current detection values to get an average current value for use in the control. Therefore, the oldest one among the three stored current detection values is updated with the newly obtained one. That is, the control signal generating unit 45 generates a control signal adjusting the average current value to become the target current value and inputs the control signal to the DC/DC converter 2 in step S9.

Specifically, for example, the control signal generating unit 45 has an error amplifier that provides an output voltage value corresponding to the difference between the average current value and the target current value, thereby generating the control signal, which is a PWM signal having an ON duty ratio depending on the output voltage value of the error amplifier. As described above, by using the average current value obtained by averaging plural current detection values in control, the influence of noise can be suppressed.

Steps S10 to S13 describe an operation of the inversion decision unit 41. In step S10, the inversion decision unit 41 decides the timing to output an inversion signal, i.e., whether it is the timing corresponding to the predetermined inversion period, based on the elapsed time, wherein the inversion period represent the period at which the inversion signals are repeatedly generated. If it is the timing to output an inversion signal, in step S11, the inversion decision unit 41 outputs the inversion signal to the inverter 3. The output frequency from the inverter 3 ranges from several hundreds of Hz to several kHz. That is, the inversion time period ranges from several hundred μs to several ms. Further, the inversion decision unit 41 decides in step S12 whether it is a period that belongs to neither of the post-inversion period TI1, the pre-inversion period TI2 nor the inversion signal output period (hereinafter, it will be referred to as a "constant power period"), based on the elapsed time, to turn off the output increasing signal in step S13 if the period belongs to the constant power period, and if otherwise, turns ON an output increasing signal in step S14.

The operations in steps S5 to S14 described above continue until power becomes off. Also, known techniques such as fault detection and protection operations, and/or changing the output power of the DC/DC converter 2 depending on ambient temperature may properly be combined in the present embodiment.

Here, the post-inversion period TI1 and the pre-inversion period TI2 are set shorter than a half of the inversion time period (i.e., ¼ of the one period T20 shown in FIG. 1 of the inverter 3). That is, if the inversion time period is longer than 400 μs, the post-inversion period TI1 may be, for example, set to 50 μs and the pre-inversion period TI2 may be set to 200 μs.

In accordance with the above configuration, by increasing the output power during the pre-inversion period TI2, the temperature drop in the discharge lamp La during the inversion is restrained. Also, by increasing the output power during the post-inversion period TI1, the temperature recovery after the temperature drop in an electrode of the discharge lamp La during the inversion is promoted, thus stabilizing the discharge in the discharge lamp La and suppressing the flickering or light extinction phenomenon and/or the electronic noises. Further, since both the post-inversion period TI1 and the pre-inversion period TI2 are set to be shorter than a half of the inversion time period, electric stress upon the discharge lamp La is restrained as compared with a case where the post-inversion period TI1 or the pre-inversion period TI2 is set longer than a half of the inversion time period. Thus, the life of the discharge lamp La would not easily be shortened.

Figure 4:
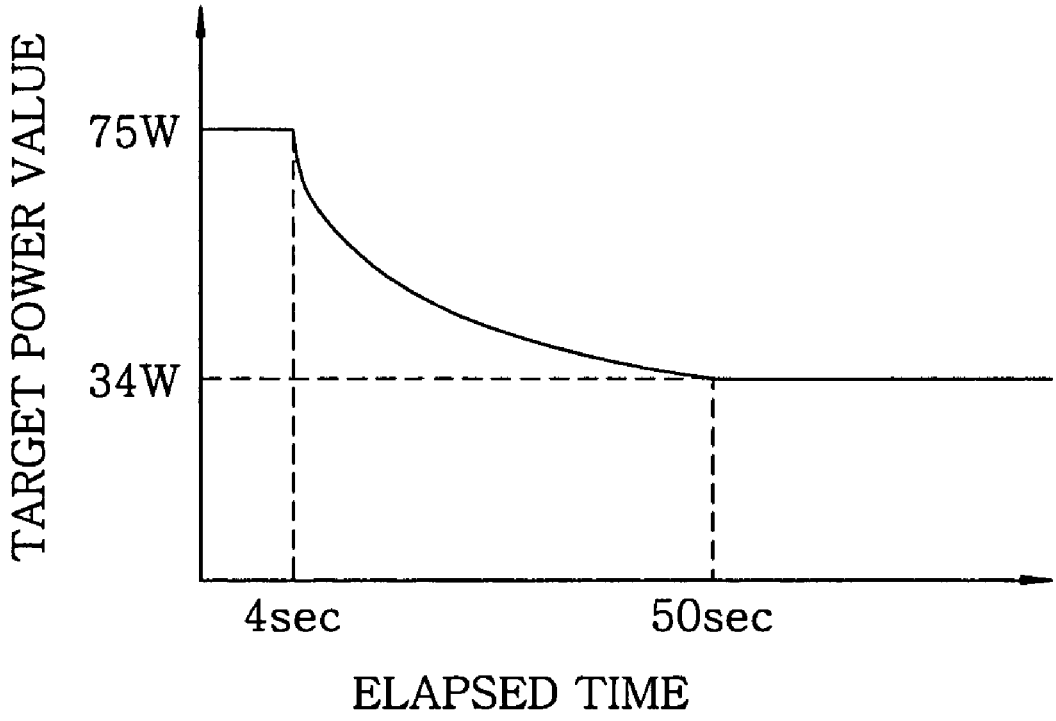
FIG. 4 is an explanatory view of a relation between elapsed time and target power value.

Here, it would be necessary to make the absolute value of an output current (lamp current) of the inverter 3 i.e., an output current of the DC/DC converter 2 (hereinafter, it will be referred to simply as "output current") during a period T30 wherein in FIG. 1 for which the output increasing signal is off not less than 50% of a rated current of the discharge lamp La in the rated power period (hereinafter, it will be referred to simply as "rated current"), to prevent the temperature drop in an electrode of the discharge lamp La during the period T30 in the rated power period the constant power period. The power period used herein denotes the period during which the rated power is applied to the discharge lamp La, i.e., the period after 50 seconds of elapsed time in the example shown in FIG. 4.

Here, it is set that output currents of the post-inversion period TI1 and the pre-inversion period T12 are p times (p>1) the rated current, and the output current during the period T30 is s times (s<1) the rated current and further the sum of one post-inversion period TI1 and one pre-inversion period TI2 is t times (t<0.5) one period T20 of the inverter 3, a condition for setting an average value of the absolute value of the output current in one period T20 of the inverter 3 as the rated current of the discharge lamp La can be defined as follows:

$$p\times 2t+s\times(1-2t)=1,$$

Here, the width of the inversion signal is assumed to negligibly small.

The above equation can be rewritten as follows:

$$s=(1-p\times 2t)/(1-2t)$$

That is, the conditions for setting the average value of the absolute value of the output current in one period T20 of the inverter 3 as the rated current of the discharge lamp La and for making the output current during the period T20 between the periods TI1 and TI2 not less than 50% of the rated current (i.e., s≧0.5) can be expressed as follows:

$$(1-p\times 2t)/(1-2t)>0.5$$

The above equation can be rewritten as follows:

$$t>0.25/(p-0.5)$$

In other words, if the length of the post-inversion period TI1 and that of the pre-inversion period TI2 are made equal, the upper limit for the length (i.e., t/2) of each of the periods TI1 and TI2 that satisfies the above conditions is about 20.8% of one period T20 when p=1.1, about 12.5% of one period T20 when p=1.5, and about 8.3% of one cycle provided that p=2. Therefore, if the length of the post-inversion period TI1 is set to equal to that of the pre-inversion period TI2, the effect of preventing the temperature drop during the constant power period is believed to be obtained when the length of each of the post-inversion and pre-inversion period TI1 and TI2 ranges from several % to 20.8% of one period T20.

Figure 5A:
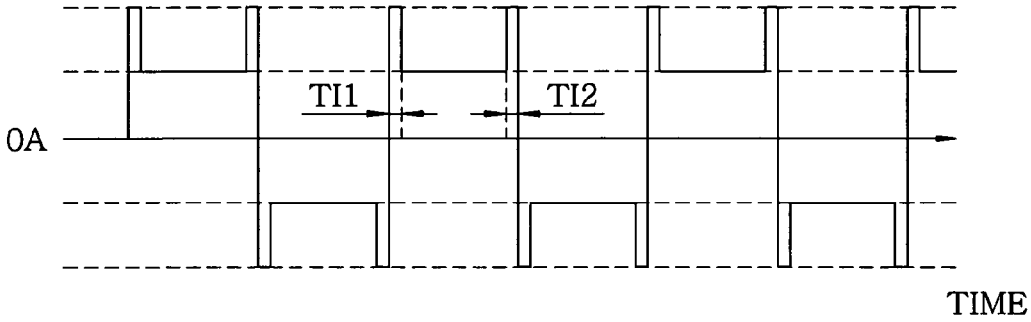
FIG. 5A is an explanatory view of a waveform of a lamp current in the first embodiment.
Figure 5B:
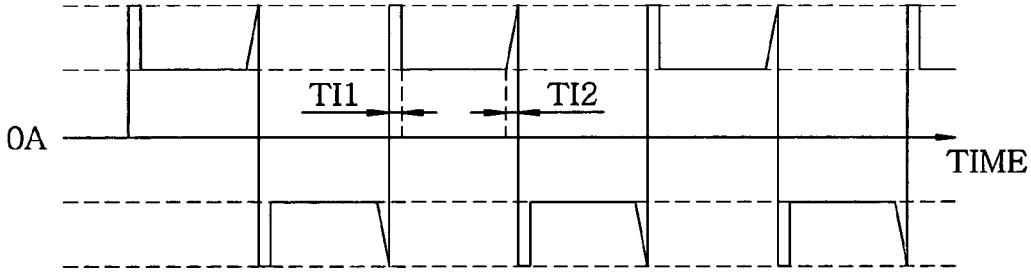
FIGS. 5B to 5D are explanatory views of a waveform of the lamp current in respective different alternative examples of the first embodiment.
Figure 5C:
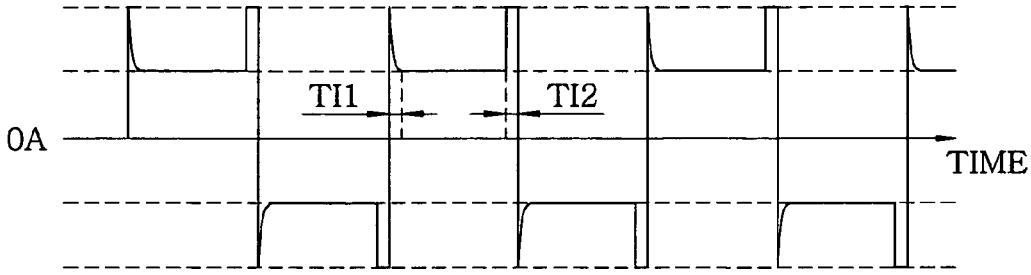
Figure 5D:
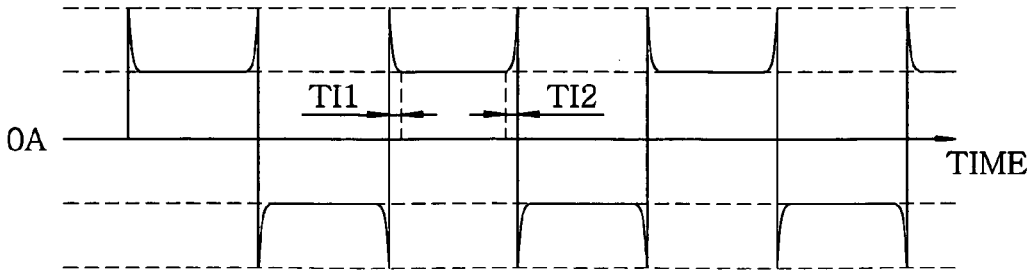
Figure 6:
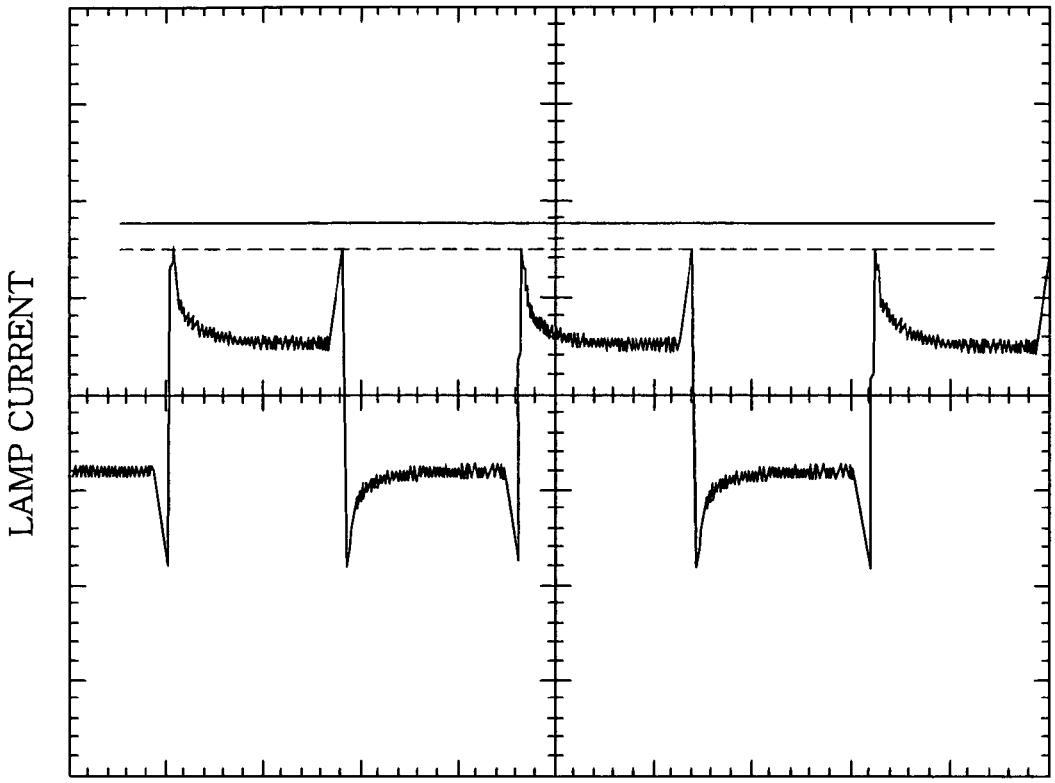
FIG. 6 is an explanatory view of an example of an actual waveform of the lamp current in the first embodiment.

Moreover, instead of having the output current waveform of the inverter 3 in the post and the pre-inversion period TI1 and TI2 in a square form as shown in FIGS. 1A to 1E or FIG. 5A, the output current may be increased linearly (i.e., an increment increases linearly starting from 0) from the output current supplied during the period T30 from the onset of the pre-inversion period TI2 to the end thereof as shown in FIGS. 5B, 5D and 6. Further, the output current may be decreased in a curve shape (i.e., an increment decreases following a curve down to 0 starting from a maximum) from the onset of the post-inversion period TI1 to the end thereof as shown in FIGS. 5C, 5D and 6. When the above configuration is adopted, electric stress upon the circuit components or the discharge lamp La can be reduced, as compared with a case where the output current (increment) at the onset of the pre-inversion period TI2 changes abruptly.

It is also possible to make the output power in the pre-inversion period TI2 greater than that in the post-inversion period TI1, instead of making the output powers in the post and pre-inversion period TI1 and TI2 equal to each other. By adopting this configuration, the temperature drop in an electrode of the discharge lamp La during inversion is restrained, which in turn enables to further reduce the flickering or lights extinction phenomenon and/or the electronic noises.

It is, however, also possible to make the output power in the pre-inversion TI2 smaller than that in the post-inversion period TI1. It is also possible to provide only one of the post and the pre-inversion period TI1 and TI2.

Second Embodiment

The basic configuration of this embodiment is the same as the first embodiment, and therefore, illustration and explanation on those common parts will be omitted.

While the increment in the first embodiment has always been fixed to a certain value, the increment in this embodiment is allowed to vary, differing from the first embodiment.

Figure 7:
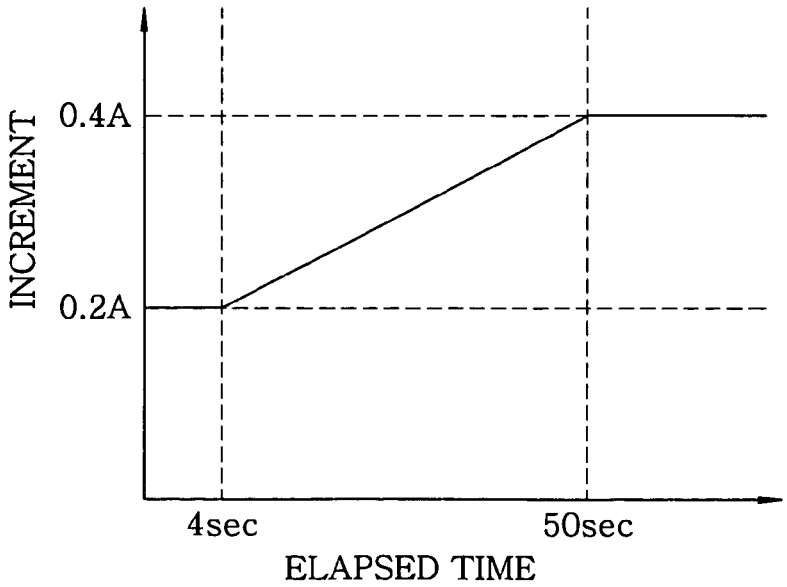
FIG. 7 is an explanatory view of an example of a relation between elapsed time and increment in a second embodiment in accordance with the present invention.
Figure 8A:
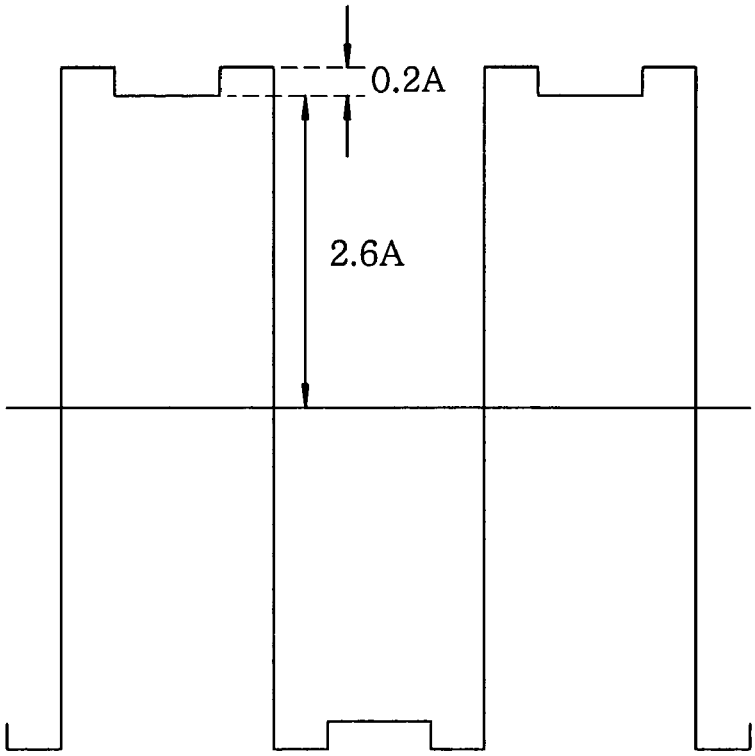
Figure 8B:
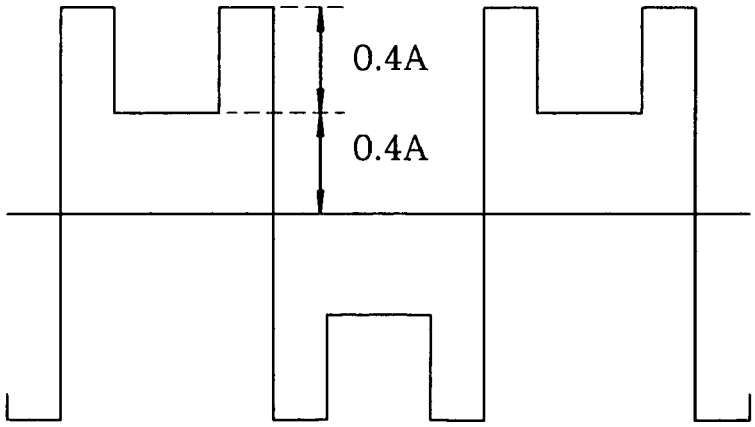

For variation of the increment, for example, the increment during the elapsed time between 0 sec and 4 sec is maintained at a minimum value (0.2 A in FIG. 7, and 0 A in FIG. 9), and then the increment may gradually and linearly increase up to a maximum value, e.g., 0.4 A during the elapsed time between 4 sec and 50 sec. That is, during the power increasing period, the increment becomes less than that in the rated power period. For instance, in an example shown in FIG. 7, when the elapsed time is 4 sec, the increment becomes 0.2 A as shown in FIG. 8A; and when the elapsed time is 50 sec or more, the increment becomes 0.4 A as shown in FIG. 8B. By varying the increment in this way, electrical stress upon the discharge lamp La and/or the circuit components in the power increasing period can be restrained, while ensuring effects of restraining the flickering or lights extinction phenomenon and/or the electronic noises in the normal period.

Figure 10:
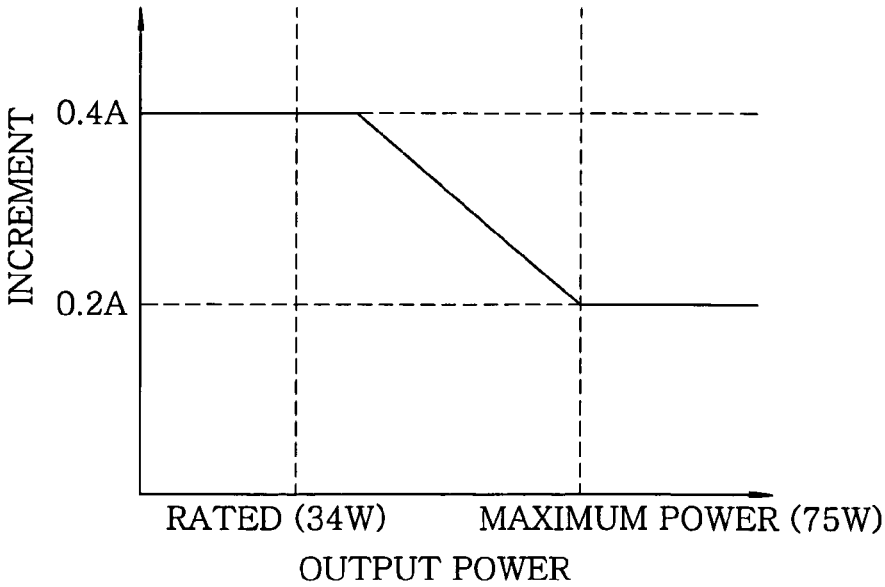
FIG. 10 is an explanatory view of an example of a relation between output power and increment in the second embodiment.
Figure 11:
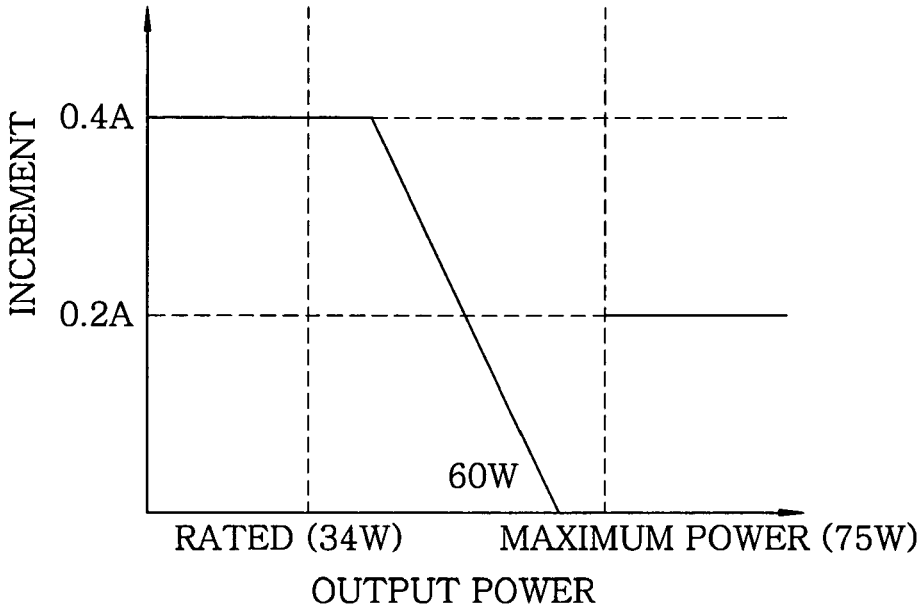
FIG. 11 is an explanatory view of another example of the relation between output power and increment in the second embodiment.

Alternatively, the target current adjusting unit 44 may be configured to detect the output power from the DC/DC converter 2, and when the output power corresponds to a maximum target power value power at the start of the power increasing period, the increment may be set to a minimum vale as shown in FIGS. 10 and 11 (0.2 A in FIG. 10, and 0 A in FIG. 11); and when the output power corresponds to the rated target power value in the normal period, the increment may be set to a maximum, e.g., 0.4 A. Further, if the output power is within a certain range between the rated power and the maximum power, the increment may be set to be smaller as the output power increases.

Figure 12:
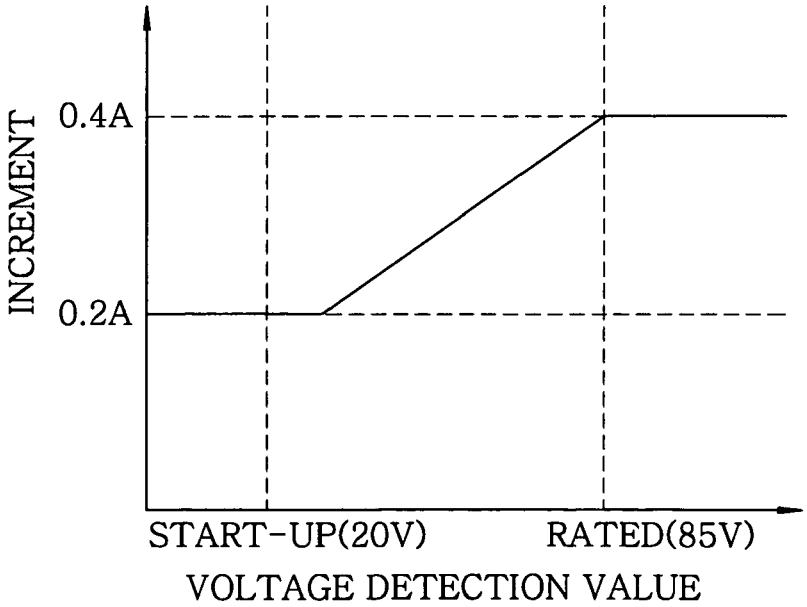
FIG. 12 is an explanatory view of an example of a relation between voltage detection value and increment in the second embodiment.
Figure 13:
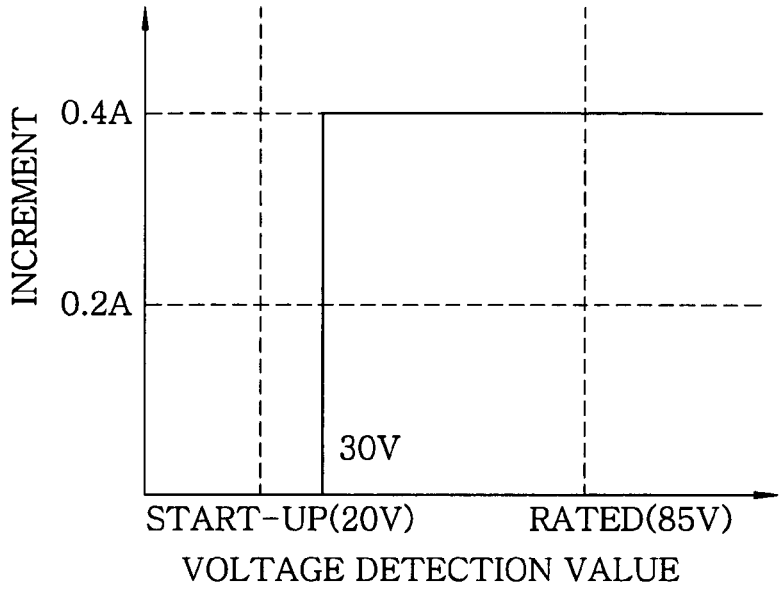
FIG. 13 is an explanatory view of another example of the relation between voltage detection value and increment in the second embodiment.

Also, as shown in FIGS. 12 and 13, when a voltage detection value corresponds to a voltage detection value, e.g., 20V expected to be measured at the start (start-up) of the power increasing period, the increment may be set to a minimum value (0.2 A in FIG. 12, and 0 A in FIG. 13); and when the voltage detection value corresponds to the rated voltage of the discharge lamp La, e.g., 85 V, expected to be measured in the normal period, the increment may be set to a maximum value (e.g., 0.4 A). In an example of FIG. 12, the increment is being gradually and linearly increased as the voltage detection value increased, provided that the voltage detection value falls within a predetermined range. In the example shown in FIG. 13, the increment has a minimum value if the voltage detection value is below 30 V, and the increment has a maximum value if the voltage detection value is not less than 30 V. That is, due to the characteristics of the discharge lamp La, the output power is expected to become higher as the voltage detection value becomes lower. Hence, when the voltage detection value is low, the increment is set small such that the output power in the post and pre-inversion period TI1 and TI2 does not become excessively high.

Figure 14:
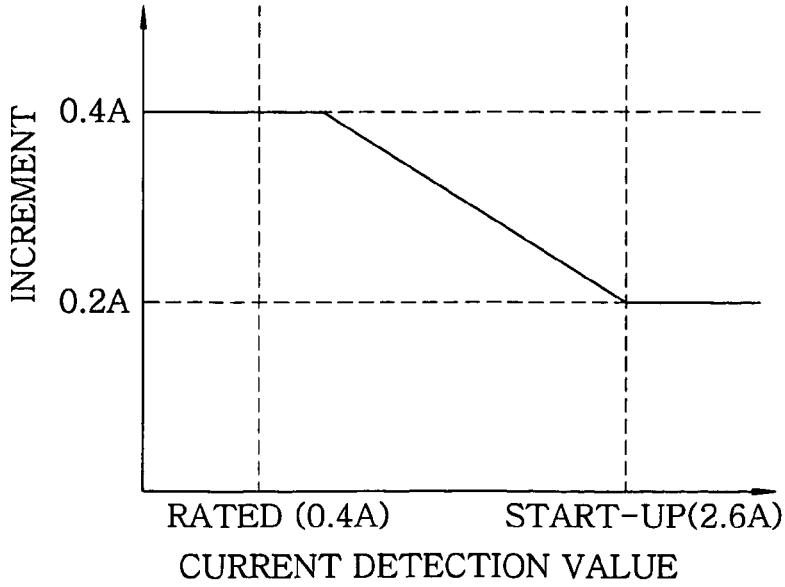
FIG. 14 is an explanatory view of an example of a relation between current detection value and increment in the second embodiment.
Figure 15:
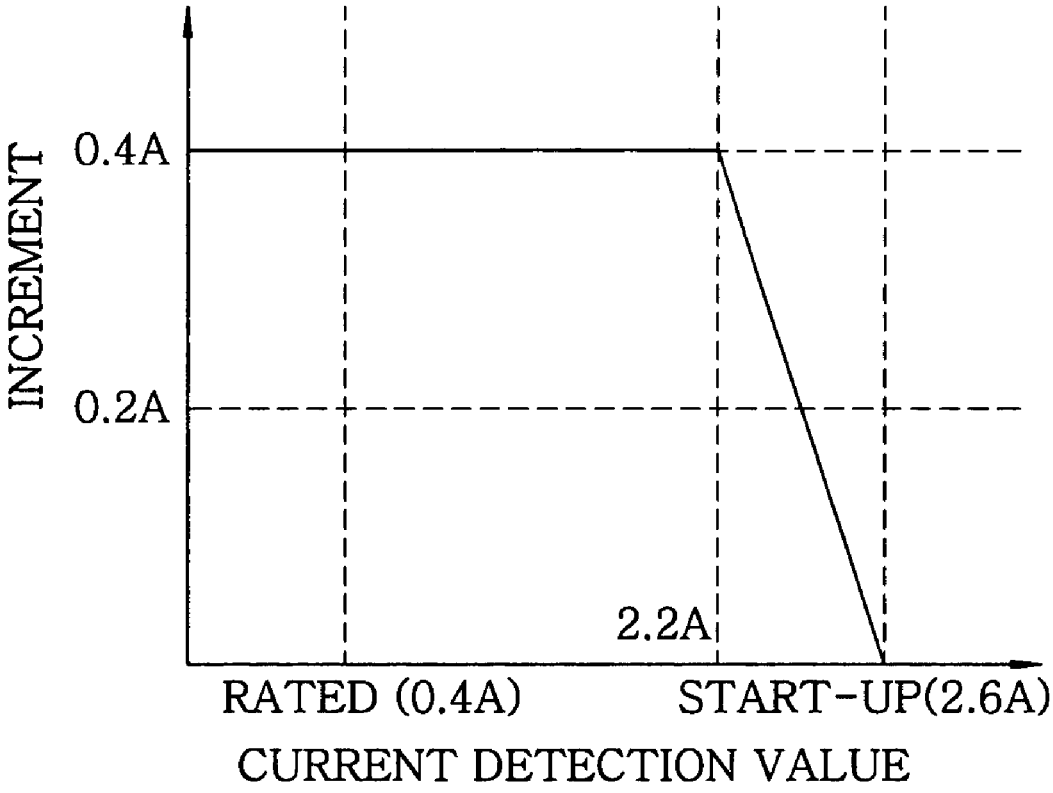
FIG. 15 is an explanatory view of another example of the relation between current detection value and increment in the second embodiment.

Also, as shown in FIGS. 14 and 15, when a current detection value corresponds to the current detection value, e.g., 2.6 A, expected to be detected at the start (start-up) of the power increasing period, the increment may be set to a minimum value (0.2 A in FIG. 14 and 0 A in FIG. 15); and when a current detection value corresponds to the current detection value expected to be detected in the rated power period (i.e., the rated current of the discharge lamp La, e.g., 0.4 A), the increment may be set to a maximum value, e.g., 0.4 A. Also, in examples shown in FIGS. 14 and 15, the increment is being gradually and linearly decreased with the increase of the current detection value, provided with the current detection value falls within a predetermined range (2.2 A to 2.6 A in the example of FIG. 15).

Figure 9:
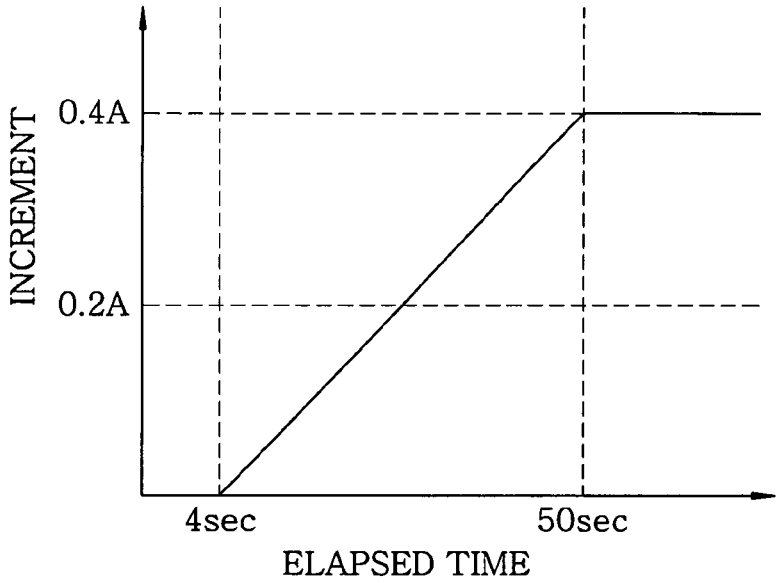
FIG. 9 is an explanatory view of another example of the relation between elapsed time and increment in the second embodiment.

Further, the increment is set to 0, during the elapsed time between 0 sec and 4 sec in the example shown in FIG. 9, during a period where the output power is not less than 60 W in the example shown in FIG. 11, during a period where the voltage detection value is below 30 V in the example shown in FIG. 13, and during a period where the current detection value is not less than 2.6 A in the example shown in FIG. 15, respectively. That is, in each of the above periods, the post and pre-inversion period TI1 and TI2 is not provided, and the output current of the DC/DC converter 2 stays constant. With these configurations, electrical stress upon the discharge lamp La is reduced, as compared with a case where the increment is not set to 0.

Third Embodiment

The basic configuration of this embodiment is the same as the first embodiment, and therefore, illustration and explanation on those common parts will be omitted.

Figure 16A:
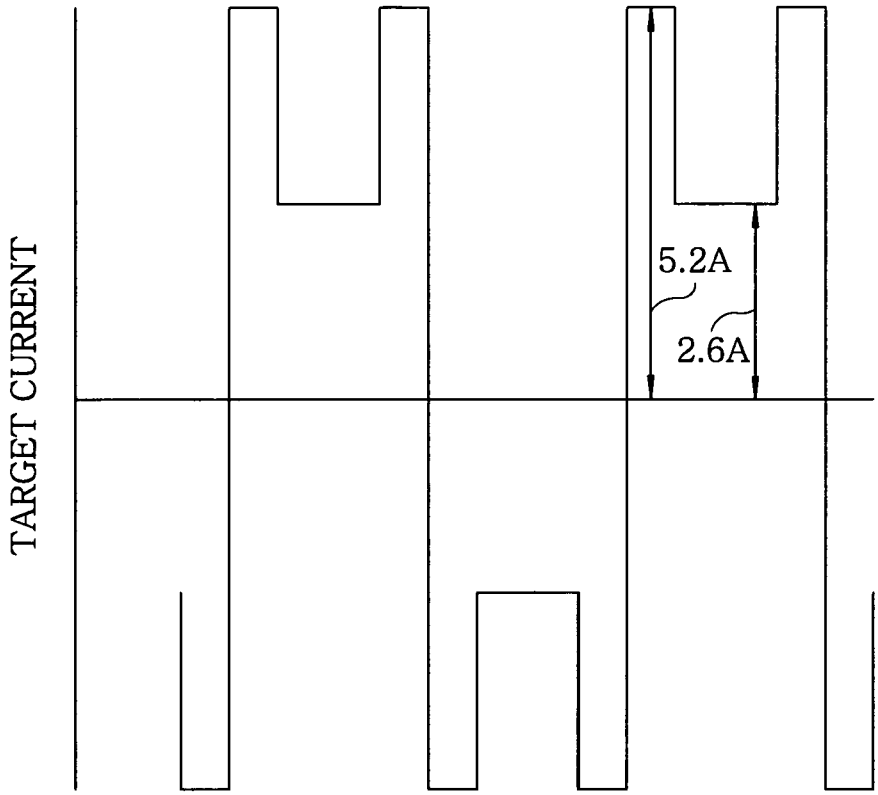
FIGS. 16A and 16B are explanatory views of an example of a waveform of a lamp current in a third embodiment in accordance with the present invention, where
Figure 16B:
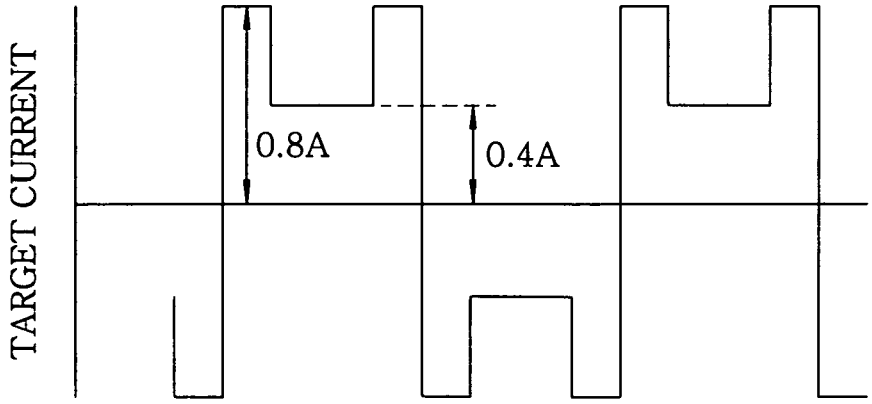

This embodiment differs from the first embodiment in that, in the first embodiment, the target current adjusting unit 44 adds the constant increment to the input target current value from the target current calculating unit 43 in the post and pre-inversion period TI1 and TI2 to increase a target current value, but in this embodiment, the target current adjusting unit 44 multiplies the input target current value from the target current calculating unit 43 by a multiplication factor not less than 1 to provided an increased target current value in the post and pre-inversion period TI1 and TI2. For instance, if the multiplication factor is 2, and the target current value in the rated power period is 2.6 A, the target current value in the post and pre-inversion period TI1 and TI2 would become 5.2 A as shown in FIG. 16A. As shown in FIG. 16B, if the target current value in the rated power period is 0.4 A, the target current value in the post and the pre-inversion period TI1 and TI2 would become 0.8 A.

Further, as the increment in the second embodiment is variable, the multiplication factor may also be varied.

Figure 17:
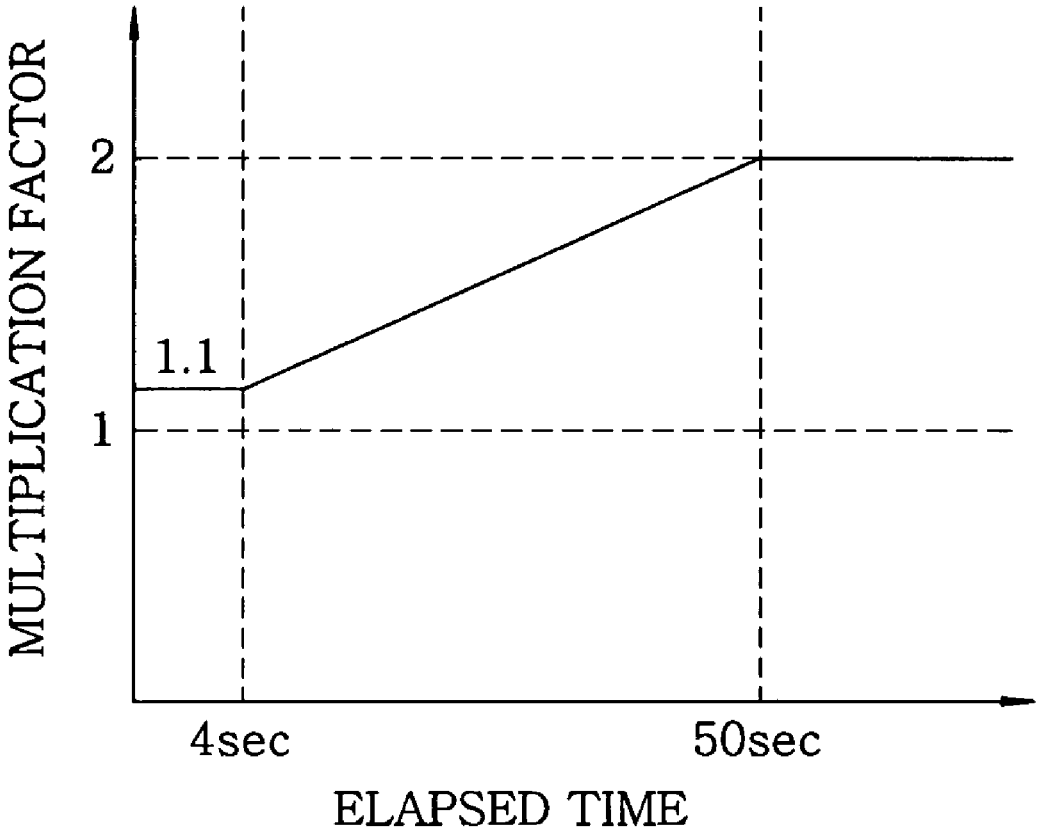
FIG. 17 is an explanatory view of an example of a relation between elapsed time and multiplication factor in the third embodiment.
Figure 18A:
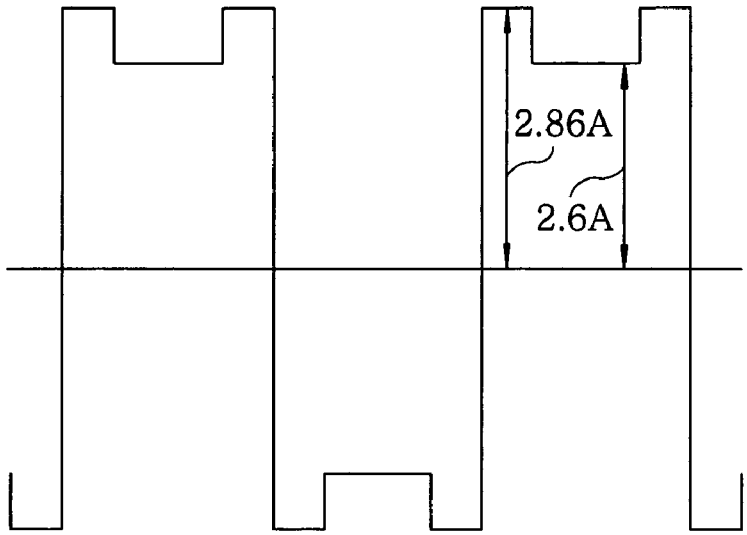
FIGS. 18A and 18B are explanatory views of the waveform of the lamp current in the example of FIG. 17, where
Figure 18B:
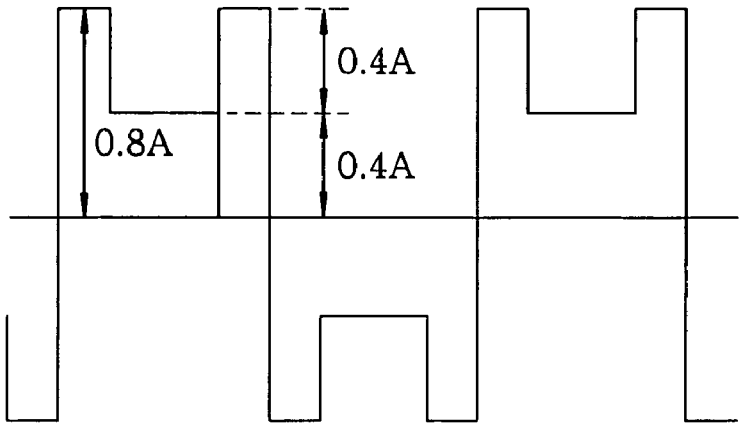
Figure 19:
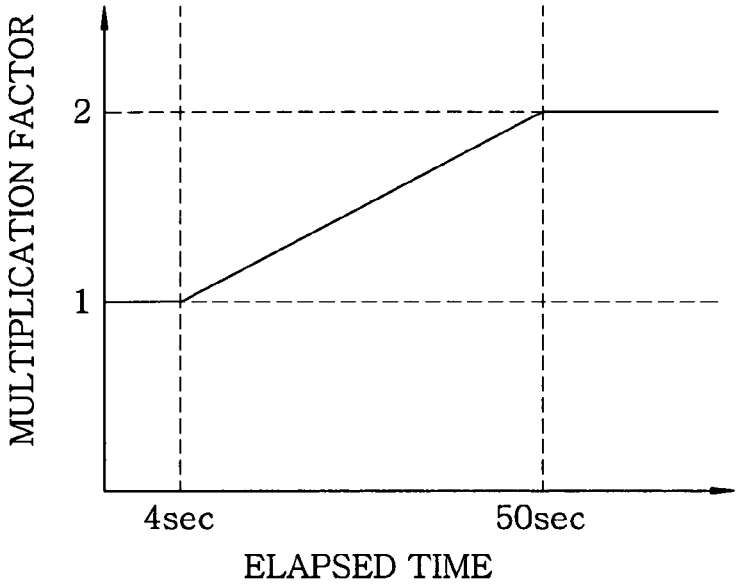
FIG. 19 is an explanatory view of another example of the relation between elapsed time and multiplication factor in the third embodiment.

For example, as shown in FIGS. 17 and 19, the multiplication factor may stay at a minimum value (1.1 in FIG. 17, and 1 in FIG. 19) during the elapsed time between 0 sec and 4 sec, and then gradually and linearly increases from the minimum value to a maximum value of, e.g., 2 during the elapsed time between 4 sec and 50 sec. That is, the multiplication factor is smaller in the power increasing period than in the rated power period. For instance, in the example of FIG. 17, when the elapsed time is 4 sec, the multiplication factor is 1.1 as shown in FIG. 18A; and when the elapsed time is 50 sec or more, the multiplication factor becomes 2 as shown in FIG. 18B. By varying the multiplication factor in this way, electrical stress upon the discharge lamp La or the circuit components in the power increasing period can be restrained, while ensuring effects of restraining the flickering or lights extinction phenomenon and/or the electronic noises in the rotated power period.

Figure 20:
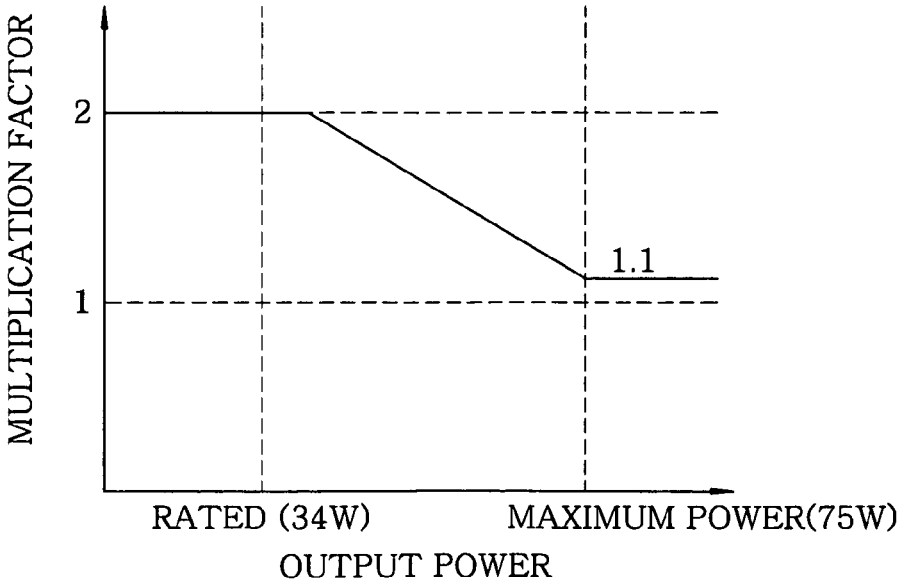
FIG. 20 is an explanatory view of an example of a relation between output power and multiplication factor in the third embodiment.
Figure 21:
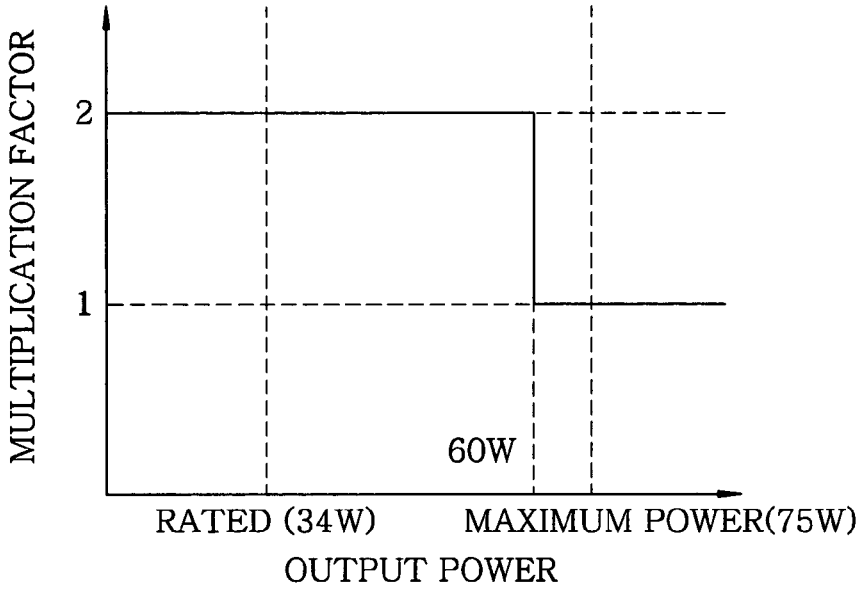
FIG. 21 is an explanatory view of another example of the relation between output power and multiplication factor in the third embodiment.

Alternatively, the target current adjusting unit 44 may be configure to detect output power from the DC/DC converter 2, as shown in FIG. 20 and FIG. 21, and when the output power corresponds to the maximum target power value provided at the start of the power increasing period, the multiplication factor may be set to a minimum vale (1.1 in FIG. 20, and 1 in FIG. 21); and when the output power corresponds to the rated target power value provided in the rated power period, the multiplication factor may be set to a maximum, e.g., 2. In an example shown in FIG. 20, when the output power is within a predetermined range, the multiplication factor is gradually and linearly decreased with the increase of the output power. In an example shown in FIG. 21, the multiplication factor has a maximum value if the output power is below 60 W, and a minimum value if the output power is not less than 60 W.

Figure 22:
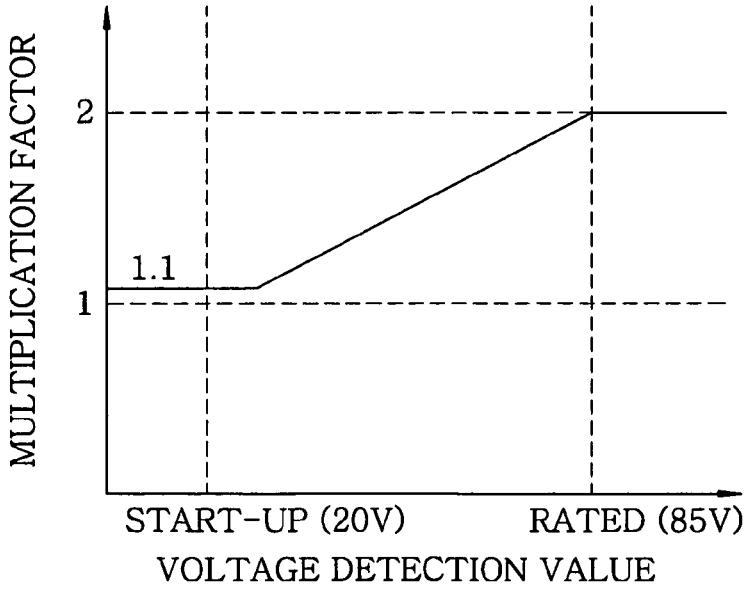
FIG. 22 is an explanatory view of an example of a relation between voltage detection value and multiplication factor in the third embodiment.
Figure 23:
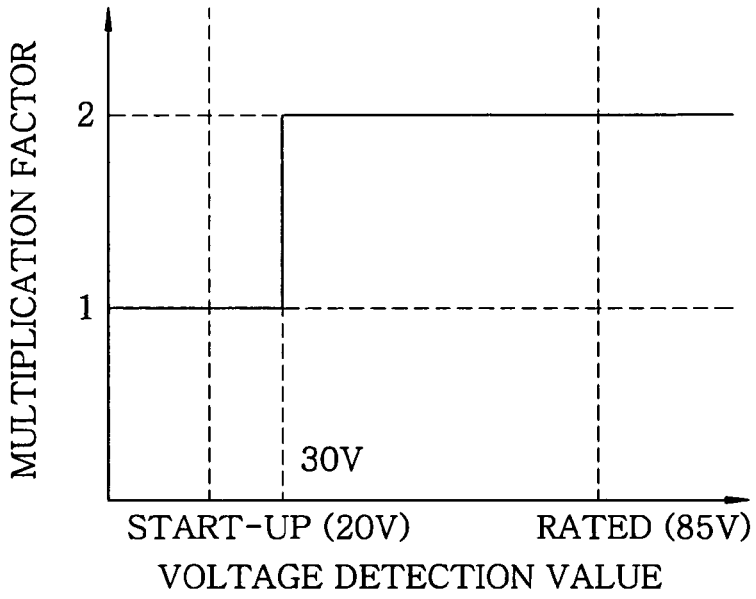
FIG. 23 is an explanatory view of another example of the relation between voltage detection value and multiplication factor in the third embodiment.

Also, as shown in FIGS. 22 and 23, when a voltage detection value corresponds to a voltage detection value, e.g., 20V expected to be measured at the start (start-up) of the power increasing period, the multiplication factor may be set to a minimum value (1.1 in FIG. 22 and 1 in FIG. 23); and when a voltage detection value corresponds to the rated voltage of the discharge lamp La, e.g., 85 V, expected to be measured in the normal period, the multiplication factor may be set to a maximum value, e.g., 2. In the example shown in FIG. 22, the multiplication factor is being gradually and linearly increased as the voltage detection value increased, provided that the voltage detection value falls within a predetermined range.

In the example shown in FIG. 23, the multiplication factor has a minimum value if the voltage detection value is below 30 V, and the multiplication factor has a maximum value if the voltage detection value is not less than 30 V. That is, due to characteristics of the discharge lamp La, the output power is expected to be become higher as the voltage detection value become lower. Hence, when the voltage detection value is low, the multiplication factor is set small such that the output power in the post-inversion period TI1 and in the pre-inversion period TI2 does not become excessively high.

Figure 24:
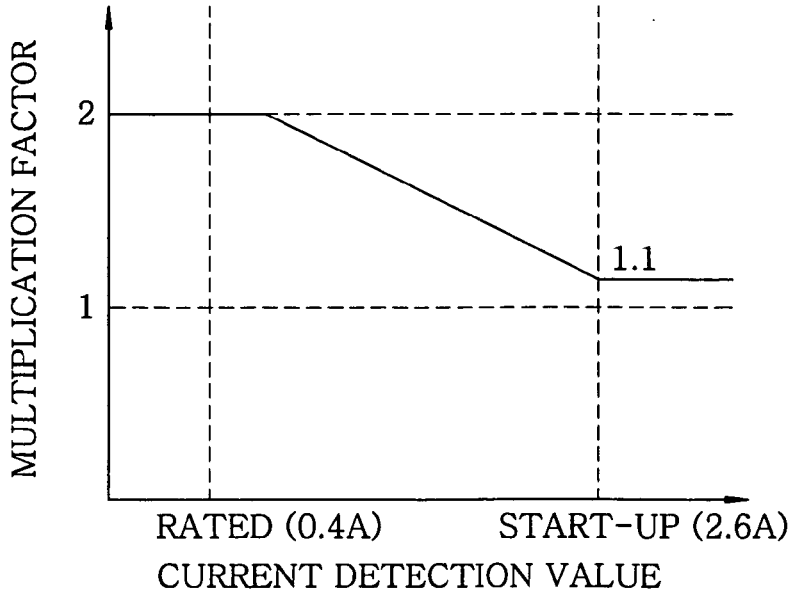
FIG. 24 is an explanatory view of an example of a relation between current detection value and multiplication factor in the third embodiment.
Figure 25:
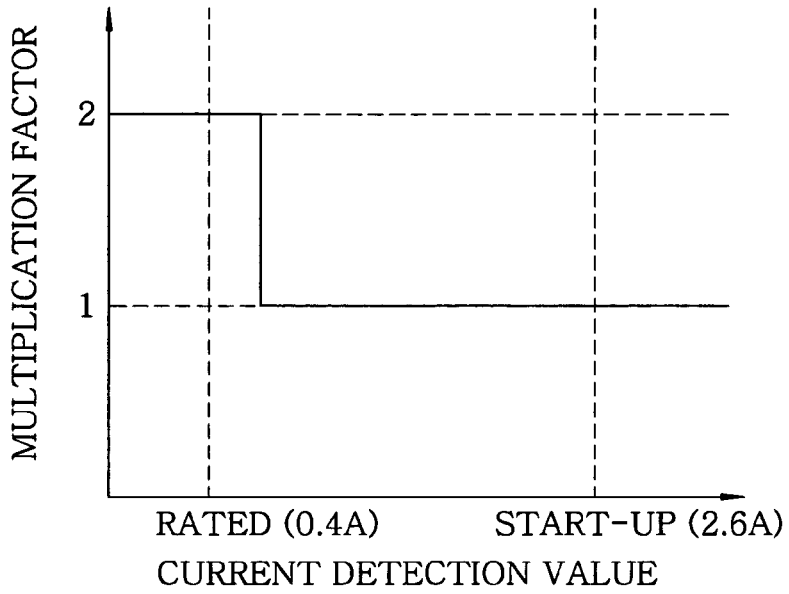
FIG. 25 is an explanatory view of another example of the relation between current detection value and multiplication factor in the third embodiment.

Also, as shown in FIGS. 24 and 25, when a current detection value corresponds to the current detection value, e.g., 2.6 A, expected to be detected at the start (start-up) of the power increasing period, the multiplication factor may be set to a minimum value (1.1 in FIG. 24, and 1 in FIG. 25); and when a current detection value corresponds to the current detection value expected to be detected in the rated power period (i.e., the rated current of the discharge lamp La, e.g., 0.4 A), the multiplication factor may be set to a maximum value, e.g., 2. In an example shown in FIG. 24, the multiplication factor is being gradually and linearly decreased with to the increase of the current detection value, provided with the current detection value falls within a predetermined range. In an example shown in FIG. 25, the multiplication factor has a minimum value if the current detection value is not less than a predetermined value, and the multiplication factor has a maximum value if the current detection value is below the predetermined value.

Further, the multiplication factor is set to 1, during the elapsed time between 0 sec and 4 sec in the example shown in FIG. 19, during a period where the output power is 60 W or more in the example shown in FIG. 21, during a period where the voltage detection value is below 30 V in the example shown in FIG. 23, and during a period where the current detection value is not less than the predetermined value in the example shown in FIG. 25, respectively. That is, in each of the above periods, the post and pre-inversion period TI1 and TI2 is not provided, and the output current from the DC/DC converter 2 stays constant. With these configurations, electrical stress upon the discharge lamp La is reduced, as compared with a case where the multiplication factor is not set to 1.

Fourth Embodiment

The basic configuration of this embodiment is the same as the first embodiment, and therefore, illustration and explanation on those common parts will be omitted.

This embodiment differs from the first embodiment in that, in the first embodiment, the length of the pre-inversion period TI2 is fixed, but in this embodiment, the length of the pre-inversion period TI2 (hereinafter, it will be referred to as "rise time") is variable.

Figure 26:
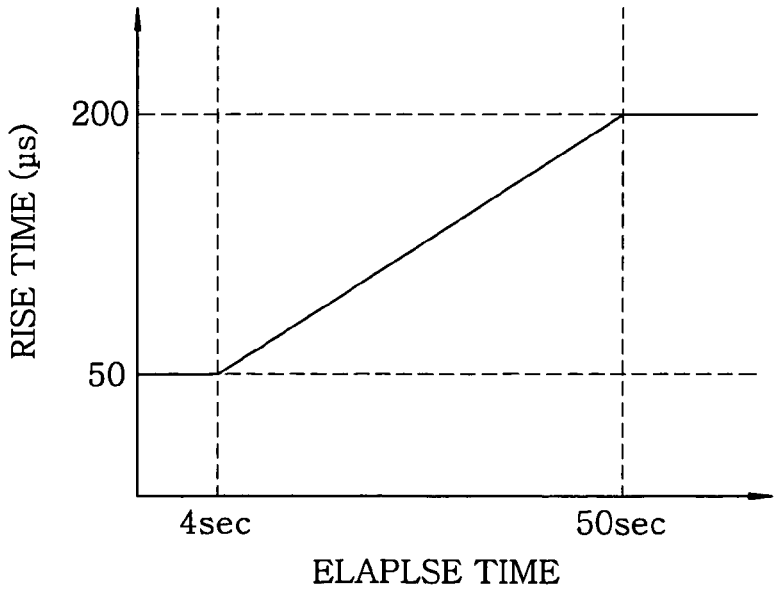
FIG. 26 is an explanatory view of an example of a relation between elapsed time and rise time in a fourth embodiment in accordance with the present invention.
Figure 27A:
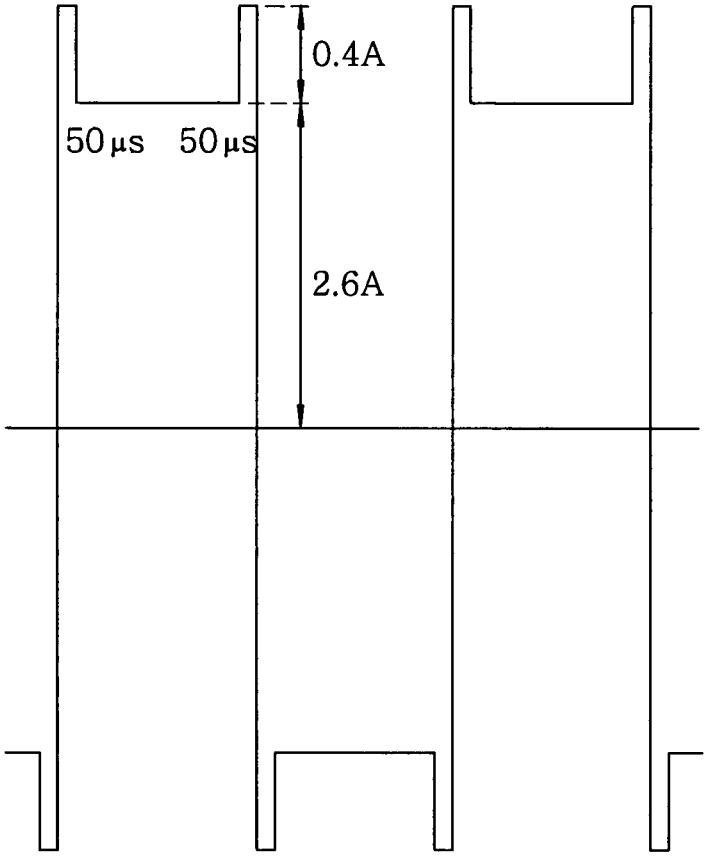
FIGS. 27A and 27B are explanatory views of a waveform of a lamp current in the fourth embodiment, where
Figure 27B:
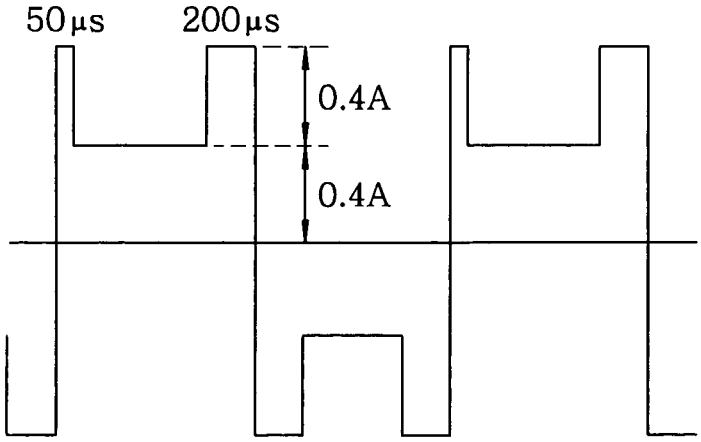
Figure 28:
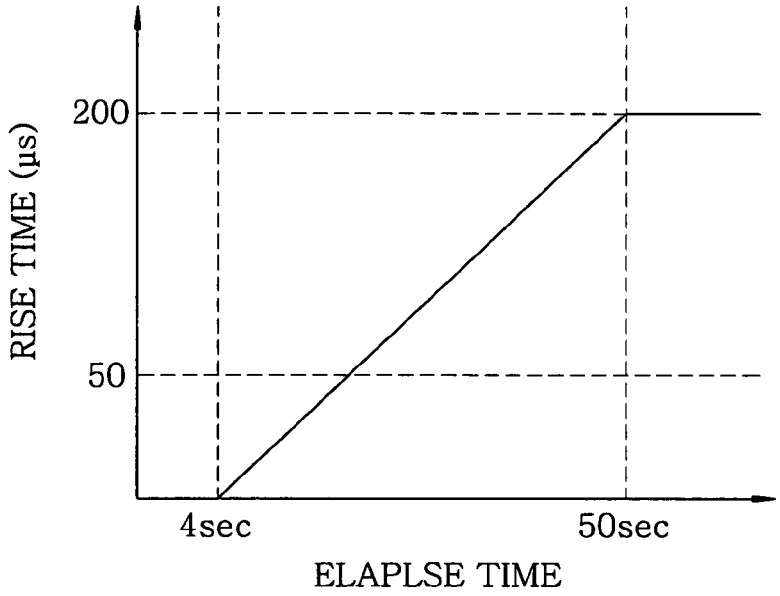
FIG. 28 is an explanatory view of another example of a relation between elapsed time and rise time in the fourth embodiment.

For change of the rise time, for example, as shown in FIG. 26 or FIG. 28, the rise time may stay at a minimum value (50 μs in FIG. 26, and 0 μs in FIG. 28) during the elapsed time between 0 sec and 4 sec, and then may gradually and linearly increase from the minimum value to a maximum value (e.g., 200 μs) during the elapsed time between 4 sec and 50 sec. That is, the rise time is shorter in the power increasing period than in the rated power period. For instance, in the example shown in FIG. 26, when the elapsed time is 4 sec, the rise time becomes 50 μs as shown in FIG. 27A; and when the elapsed time is 50 sec or more, the rise time becomes 200 μs as shown in FIG. 27B. By varying the rise time in this way, electrical stress upon the discharge lamp La and/or the circuit components in the power increasing period can be restrained, while ensuring effects of restraining the flickering or light extinction phenomenon and/or the electronic noises in the normal period.

Figure 29:
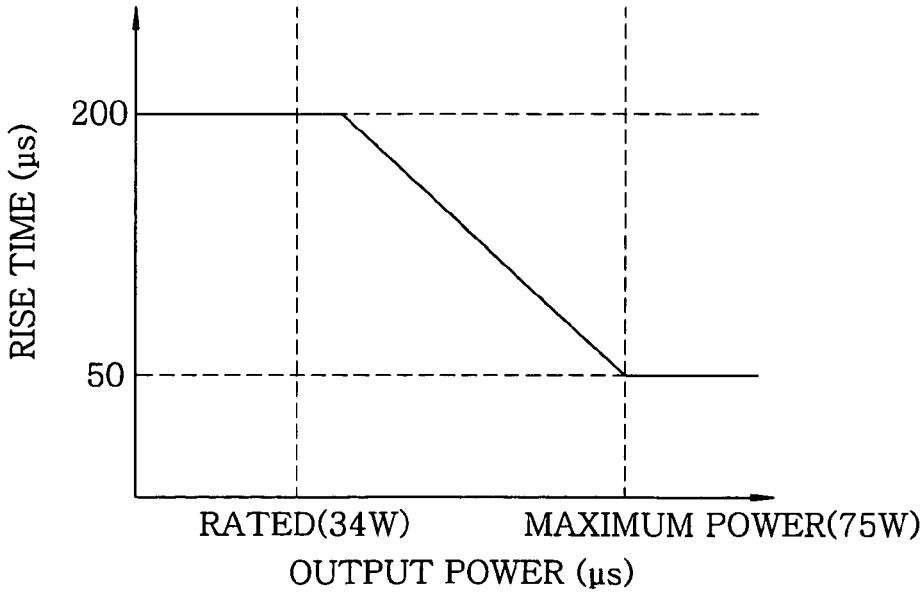
FIG. 29 is an explanatory view of an example of a relation between output power and rise time in the fourth embodiment.
Figure 30:
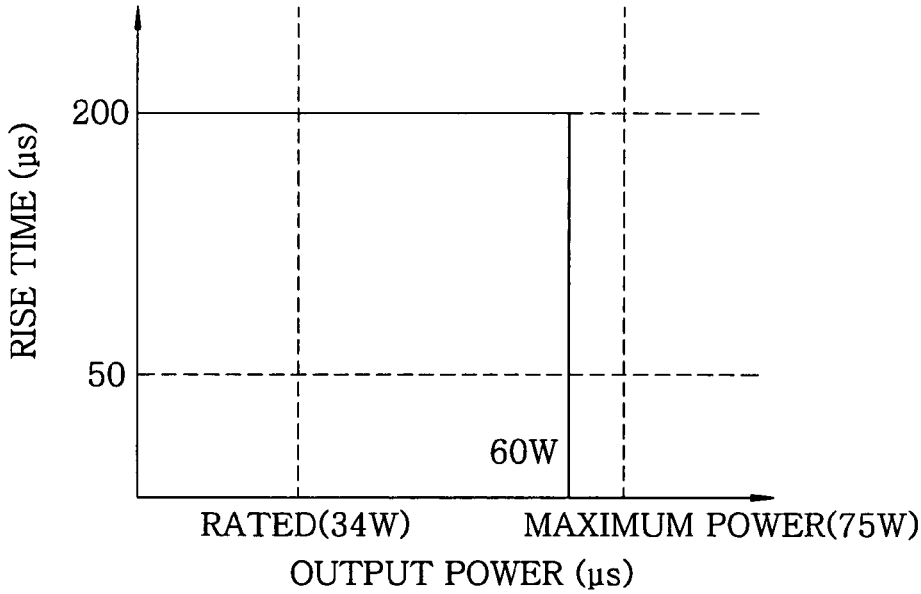
FIG. 30 is an explanatory view of another example of the relation between output power and rise time in the fourth embodiment.

The inversion detection unit 41 may be configured to detect output power from the DC/DC converter 2, and when the output power corresponds to the maximum target power value provided at the start of the power increasing period, the rise time may be set to a minimum vale as shown in FIG. 29 or FIG. 30 (50 μs in FIG. 29, and 0 μs in FIG. 30); and when the output power corresponds to the rated target power value provide in the rated power period, the rise time may be set to a maximum, e.g., 200 μs. In an example shown in FIG. 29, when the output power is within a predetermined range, the rise time is gradually and linearly shortened with to the increase of the output power. In an example shown in FIG. 30, the rise time has a maximum value if the output power is below 60 W, and the rise time has a minimum value if the output power is not less than 60 W.

Figure 31:
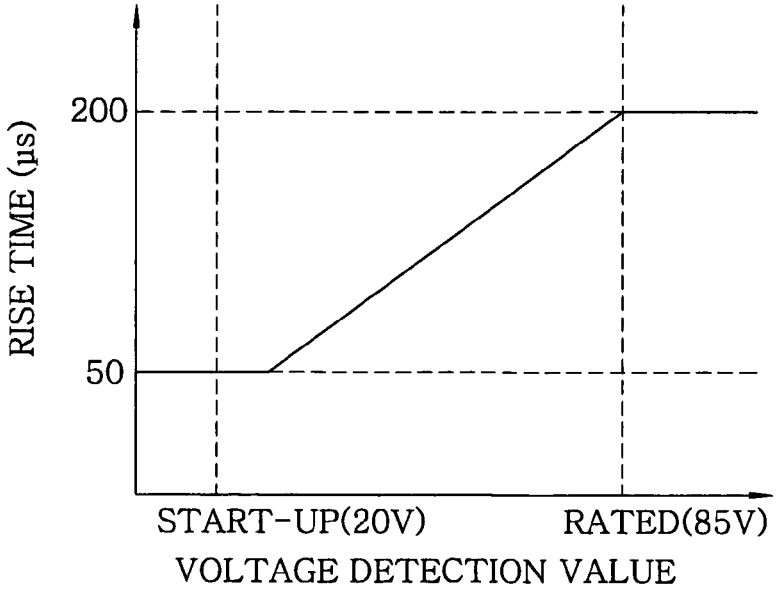
FIG. 31 is an explanatory view of an example of a relation between voltage detection value and rise time in the fourth embodiment.
Figure 32:
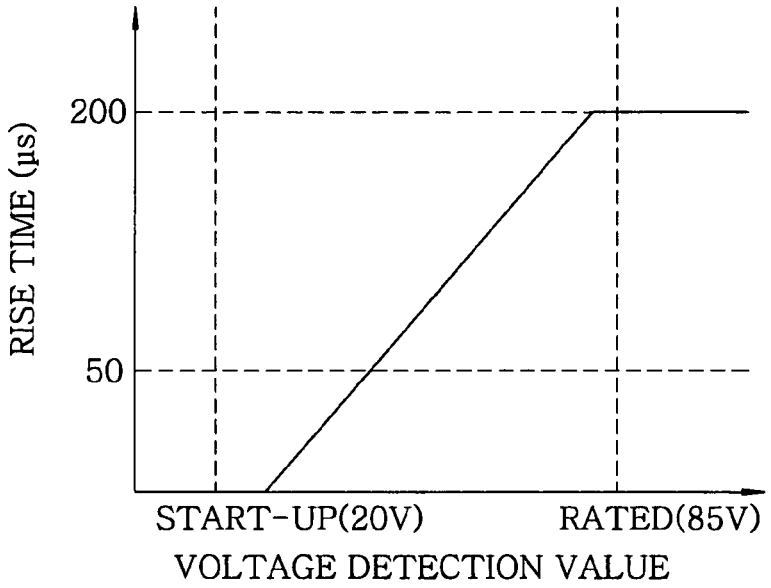
FIG. 32 is an explanatory view of another example of the relation between voltage detection value and rise time in the fourth embodiment.

As shown in FIGS. 31 and 32, when a voltage detection value corresponds to a voltage detection value, e.g., 20V, expected to be measured at the start (start-up) of the power increasing period, the rise time may be set to a minimum value (50 μs in FIG. 31, and 0 μs in FIG. 32); and when a voltage detection value corresponds to the rated voltage of the discharge lamp La, e.g., 85 V, expected to be measured in the normal period, the rise time may be set to a maximum value, e.g., 200 μs. In the examples shown in FIGS. 31 and 32, the rise time is being gradually and linearly increased as the voltage detection value increased, provided that the voltage detection value falls within a predetermined range. That is, due to characteristics of the discharge lamp La, the output power is expected to become higher as the voltage detection value is become lower. Hence, when the voltage detection value is low, the rise time is set short such that electrical stress in the pre-inversion period TI2 can be restrained.

Figure 33:
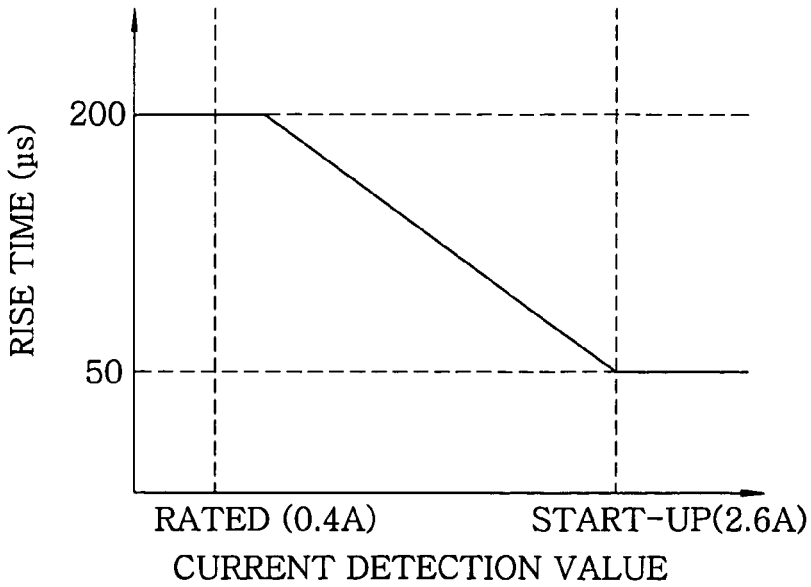
FIG. 33 is an explanatory view of an example of a relation between current detection value and rise time in the fourth embodiment.
Figure 34:
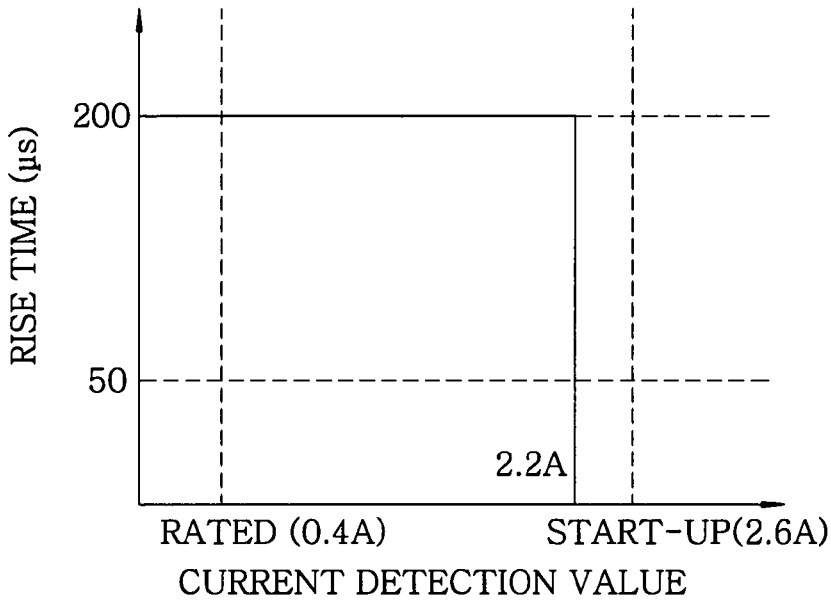
FIG. 34 is an explanatory view of another example of the relation between current detection value and rise time in the fourth embodiment.

Also, as shown in FIGS. 33 and 34, when a current detection value corresponds to the current detection value, e.g., 2.6 A, expected to be detected at the start (start-up) of the power increasing period, the rise time may be set to a minimum value (50 μs in FIG. 33, and 0 μs in FIG. 34); and when a current detection value corresponds to, the current detection value expected to be detected in the rated power period (i.e., the rated current of the discharge lamp La, e.g., 0.4 A), the rise time may be set to a maximum value, e.g., 200 μs. In an example shown in FIG. 33, the rise time is being gradually and linearly reduced with the increase of the current detection value, provided with the current detection value falls within a predetermined range. In an example shown in FIG. 34, the rise time has a minimum value if the current detection value is not less than 2.2 A, and the rise time has a maximum value if the current detection value is below the predetermined value.

Further, the rise time is set to 0 μs, during the elapsed time between 0 sec and 4 sec in the example shown in FIG. 28, during a period where the output power is 60 W or more in the example shown in FIG. 30, during a period where the voltage detection value is below a predetermined value in the example shown in FIG. 32, and during a period where the current detection value is not less than 2.2 A in the example shown in FIG. 34, respectively. That is, in each of the above periods, the pre-inversion period TI2 is not provided, and the output current of the DC/DC converter 2 stays constant, except for the post-inversion period TI1. With these configurations, electrical stress upon the discharge lamp La is reduced, as compared with a case where the rise time is not set to 0 μs.

Also, although in this embodiment the length of the pre-inversion period TI2 is assumed variable, the length of the post-inversion period TI1 or the length of both the pre and the post-inversion period TI1 and TI2 may be assumed variable to provide the same effects.

Also, the change in rise time set forth in this embodiment may be adopted in combination of the change in increment mentioned in the second embodiment and the change in multiplication factor in the third embodiment.

Figure 35:
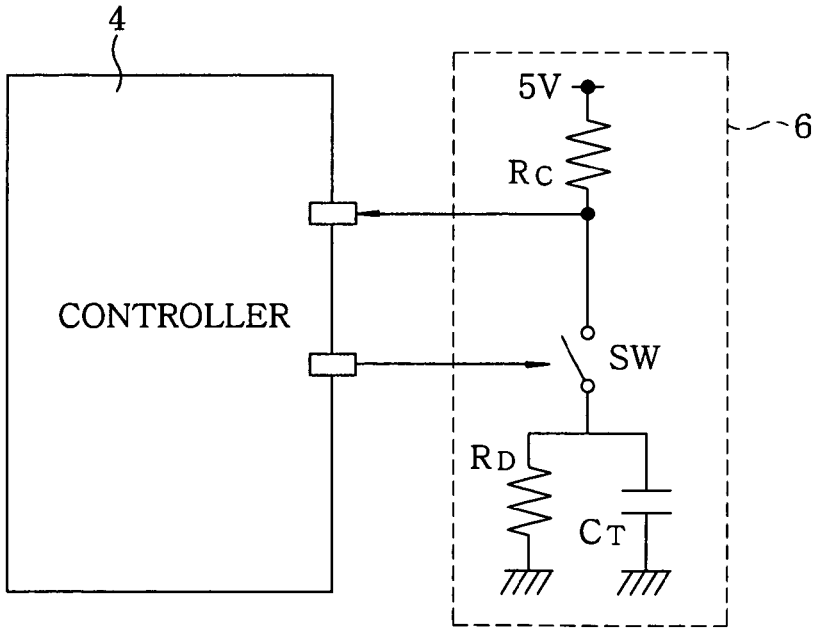
FIG. 35 is a circuit block diagram of a key part of a modified example of the fourth embodiment.

If the temperature of the discharge lamp La is somewhat high at the time when turning on the discharge lamp La, for example, if the discharge lamp La is turned on again shortly after the discharge lamp La was turned off, the power increasing period can be made shorter compared with a case where the temperature of the discharge lamp La is low. In such a case, it is also preferable to make the power increasing period shorter in order to reduce undue electrical stress upon the circuit components or the discharge lamp La. In view of the above, it may be preferable that the first to the fourth embodiment are provided with a temperature estimation unit 6 as shown in FIG. 35 to estimate temperature of the discharge lamp La.

In such a case, the controller 4 may be configured to start counting the elapsed time from an estimate initial value other than 0 sec, wherein the estimated initial value is set to be greater as the temperature estimated by the temperature estimation unit 6 is higher. The temperature estimation unit 6 shown in FIG. 35 includes a parallel circuit, which includes a resistor RD and a capacitor CT whose one ends are connected to the ground, and a resistor RC whose one end is connected to the parallel circuit via a switching SW and whose other end is connected to, e.g., a 5V constant voltage source.

The operation of the switch is controlled by the controller 4, e.g., the inversion decision unit 41 thereof so that the switch SW may be turned on (i.e., closed) when the discharge lamp La is turned on, and may be turned off (i.e., opened) when the light of the discharge lamp La is turned off. That is, the capacitor CT of the temperature estimation unit 6 is charged through the resistor RC while the discharge lamp La is being lighted, and is discharged through the resistor RD while the light of the discharge lamp La is turned off.

Therefore, immediately after the discharge lamp La is turned on, namely, immediately after the switch SW is turned on, the charge voltage of the capacitor CT is inputted to the controller 4 as an output voltage of the temperature estimation unit 6. When the discharge lamp La is turned on again after it was turned off, the shorter the turned-off period, i.e., the period during which the discharge lamp La has remained off before being turned on again, is and the longer the turned-on period, i.e., the period during which the discharge lamp La had remained turned on before being turned off, is, the higher the output voltage of the temperature estimation unit 6 would be.

Figure 36:
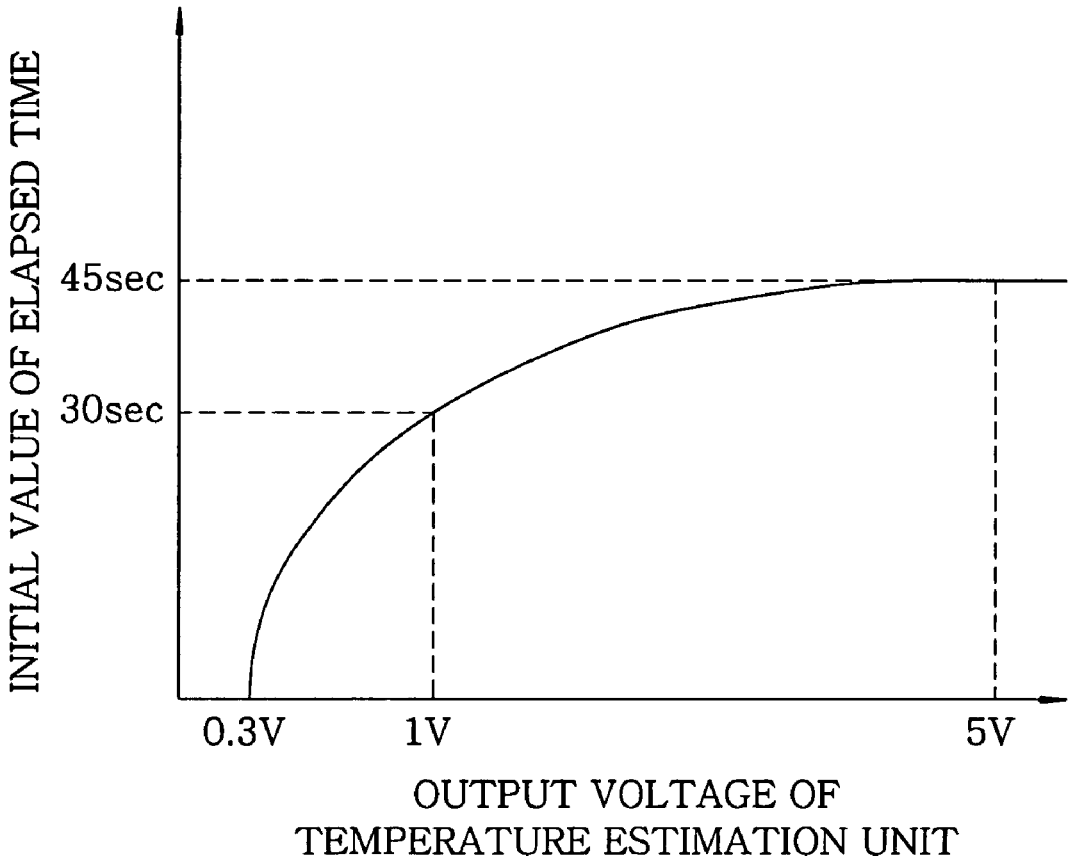
FIG. 36 is an explanatory view of an example of an operation of the modified example in FIG. 35.

That is, it may be judged that the higher the output voltage of the temperature estimation unit 6 is, the higher the temperature of the discharge lamp La would be. The controller 4 stores, e.g., a relationship between the output voltage of the temperature estimation unit 6 and the estimated initial value of the elapsed time as shown in FIG. 36, and, when the discharge lamp La is lighted, sets the estimated initial value to be greater for higher output voltage of the temperature estimation unit 6 (i.e., if the estimated temperature of the discharge lamp La is higher). For instance, in the case shown in FIG. 36, if the output voltage from the temperature estimation unit 6 when the discharge lamp La is lighted is 1 V, then the elapsed time counting starts from 30 sec, which resultantly shortens the power increasing period by 30 sec. Any known temperature sensor disposed close to the discharge lamp La may be employed in lieu of the temperature estimation unit 6. In this case, an actual temperature of the discharge lamp La can be estimated based on the temperature detected by the temperature sensor.

Figure 37:
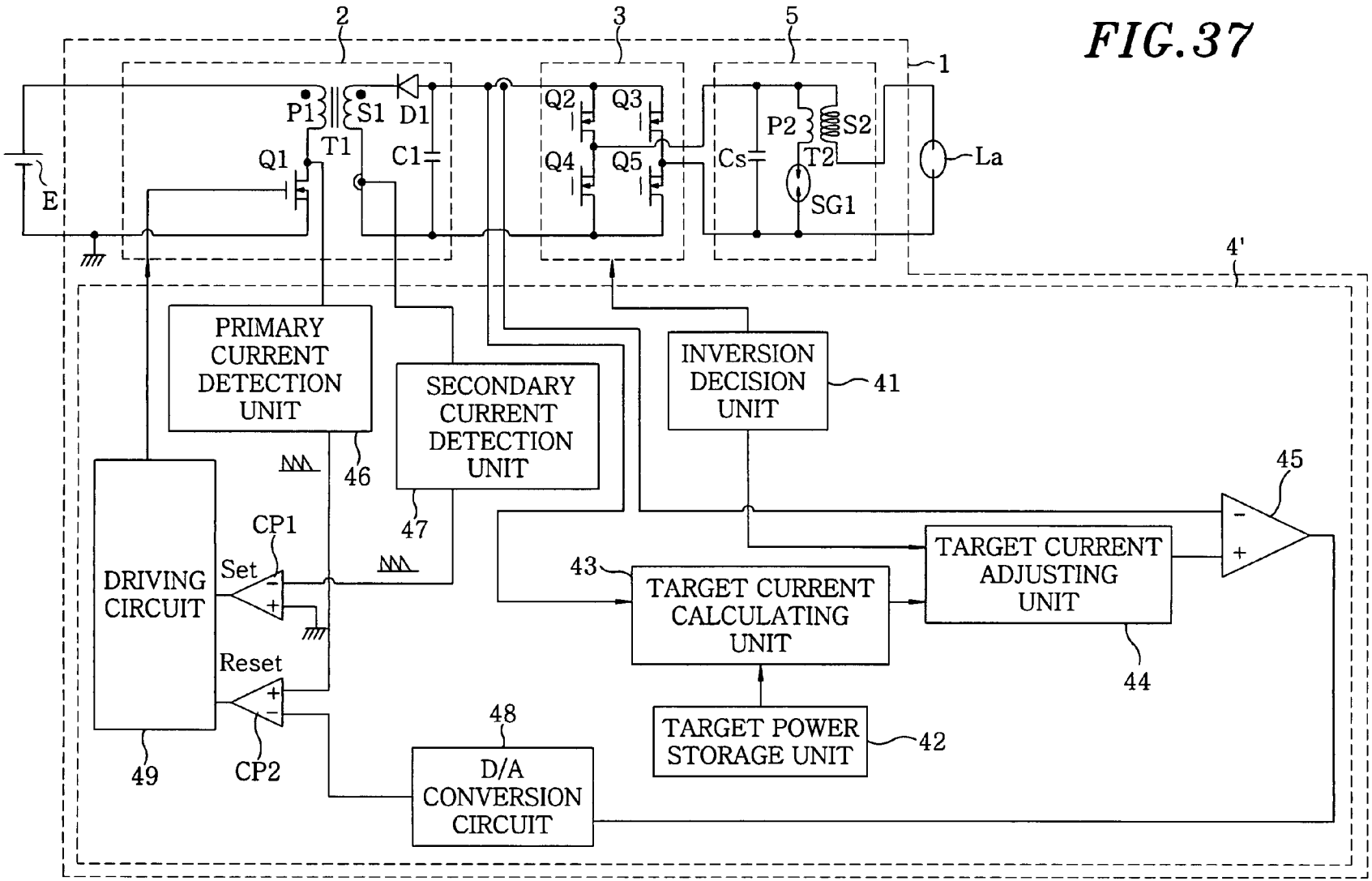
FIG. 37 is a circuit block diagram of another modified example of the fourth embodiment.

Further, the controller 4 in each of the first to the fourth embodiment may be modified to be a controller 4' as shown in FIG. 37. The controller 4' shown in FIG. 37 further includes: a primary current detection unit 46 for detecting a current flowing in the primary coil P1 (hereinafter, referred to as a "primary current") of the transformer T1 of the DC/DC converter 2; a secondary current detection unit 47 for detecting a current flowing in the secondary coil S1 (hereinafter, referred to as a "secondary current") of the transformer T1 of the DC/DC converter 2; and a D/A conversion circuit 48 for performing D/A conversion on t control signal (PWM signal) outputted from the control signal generating unit 45 to generate an output voltage value varying depending on the ON duty of the control signal (i.e., a higher output voltage value is obtained from the D/A conversion circuit 48 as a higher current is required to be generated from the DC/DC converter 2).

The controller 4' further includes: a first comparator CP1 where a non-inversion input terminal is grounded and the secondary current detection unit 47 is connected to an inversion input terminal; a second comparator CP2 in which the primary current detection unit 46 is connected to the non-inversion input terminal and the D/A conversion circuit 48 is connected to the inversion input terminal; and a driving circuit 49 including a flip-flop circuit, in which a set terminal is connected to the output terminal of the first comparator CP1 while a reset terminal is connected to the output terminal of the second comparator CP2, and a Q terminal is connected to the switching element Q1 of the DC/DC converter 2.

That is, the switching element Q1 is turned on when the value of the secondary current detected by the secondary current detection unit 47 is 0, and the switching element Q1 is turned off when the value of the primary current detected by the primary current detection unit 46 is greater than the current value directed by the control signal generating unit 45. In other words, efficiency of the transformer T1 is improved since the switching element Q1 is turned on when the secondary current becomes 0, and the output power of the DC/DC converter 2 is controlled under the feedback control based on the primary current. Moreover, the driving circuit 49 counts an amount of time during which the switching element Q1 is off (hereinafter, referred to as "off-time"), and thus when the off-time reaches a predetermined maximum off-time, the driving circuit 49 turns on the switching element Q1 even if the set terminal is not at the H level (i.e., even if the secondary current is not 0). In addition, the driving circuit 49 has a function of controlling the maximum off-time, in, e.g., such a state, where the temperature of the discharge lamp La is low, to avoid an increase in the peak current due to the switching frequency drop of the switching element Q1 in a case where the output voltage from the DC/DC converter 2 is low and the waveform of the secondary current has a small gradient. Moreover, the control signal generating unit 45 outputs a PWM signal of upper 8 bits of the control signal and another PWM signal of lower 8 bits of the control signal from different terminals, and the D/A conversion circuit 48 sequentially performs D/A conversion on each of the two PWM signals and adds two converted signals to output an analog signal of a 16-bit resolution.

Figure 38:
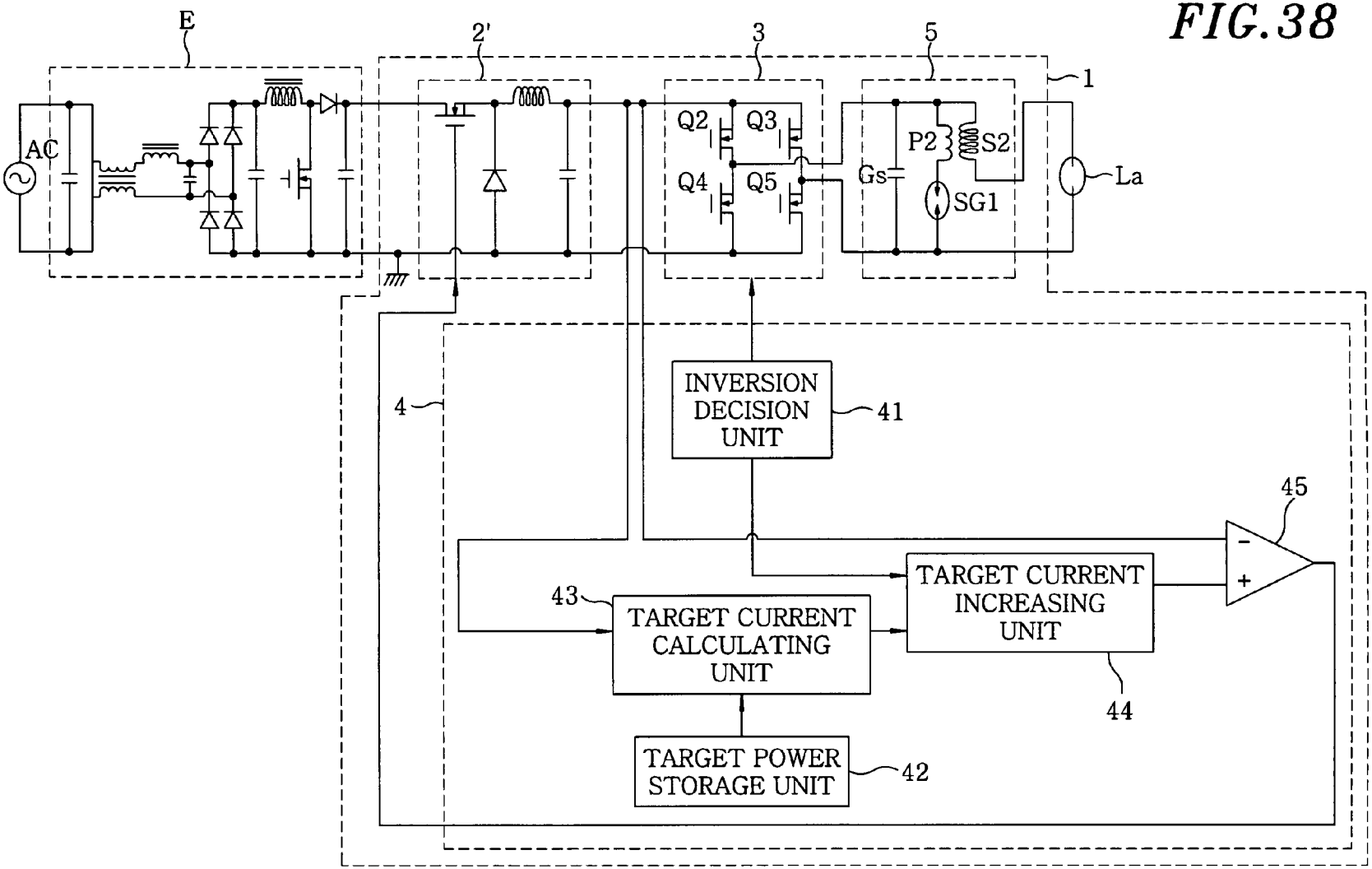
FIG. 38 is a circuit block diagram of still another modified example of the fourth embodiment.

Further, the DC/DC converter 2 in each of the first to the fourth embodiment, may be replaced with a conventional buck converter (step-down chopper circuit) 2' as shown in FIG. 38. In an example shown in FIG. 38, an AC/DC converter, which converts AC power from an AC power source into DC power, is used as the DC power source E for supplying power to the DC/DC converter 2'. This AC/DC converter is a well known combination of a filter circuit, a rectification and smoothing circuit, and a boost converter; and, therefore, detailed description thereof will be omitted.

Alternatively, the switching element of the inverter 3 may have a circuit structure serving as a switching element for the DC/DC converter 2' as well. Detailed description on this circuit structure will be omitted since it can be embodied by known technique.

Also, in the first to fourth embodiments, the output power in the post and the pre-inversion period TI1 and TI2 was increased by making a target current value higher. However, this may also be done by increasing a target power value. Alternatively, if the discharge lamp lighting device 1 is configured to control a voltage detection value to approach a target voltage value that is obtained by dividing the target power value by a current detection value, the output power in the post and the pre-inversion period TI1 and TI2 can be made to increase by increasing the target voltage value.

Further, if the output power from the DC/DC converter 2 is changed by on duty of the input control signal (PWM signal) as in the example shown in FIG. 2, and also by its frequency, the DC/DC converter 2 may be controlled by the frequency of a control signal that is inputted thereto from the controller 4. The control by ON duty of the control signal may be used separately from the control by the frequency of the control signal. For example, the output control shown in FIG. 4 may be made by changing the on duty of the control signal, the control on the magnification factor in the third embodiment can be achieved by varying the frequency of the control signal, while maintaining the frequency of the control signal constant, during the period T30 during which the output increasing signal is off as shown in FIG. 1.

Figure 39:
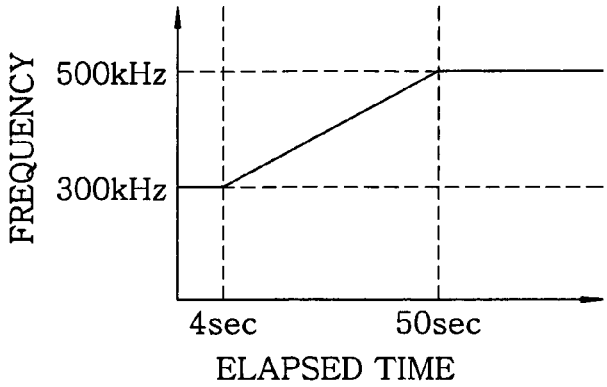
FIG. 39 is an explanatory view of an example of a relation between frequency of a control signal and elapsed time in post-inversion and pre-inversion periods in another modified example of the fourth embodiment.
Figure 40A:
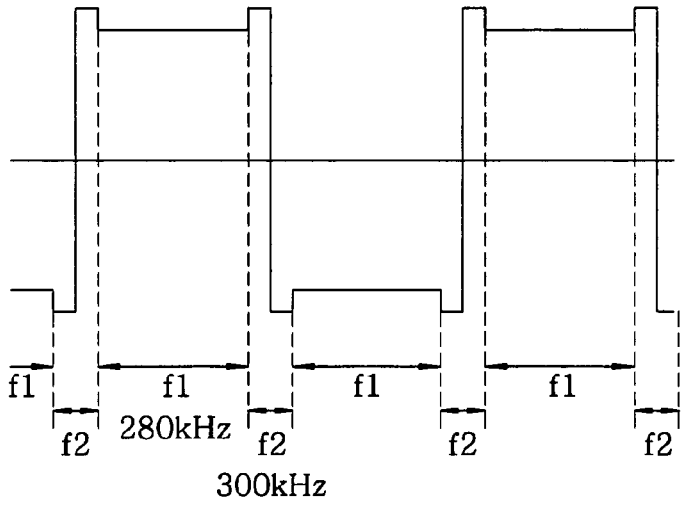
FIGS. 40A and 40B are explanatory views of waveforms of a lamp current in the modified example in FIG. 39, where
Figure 40B:
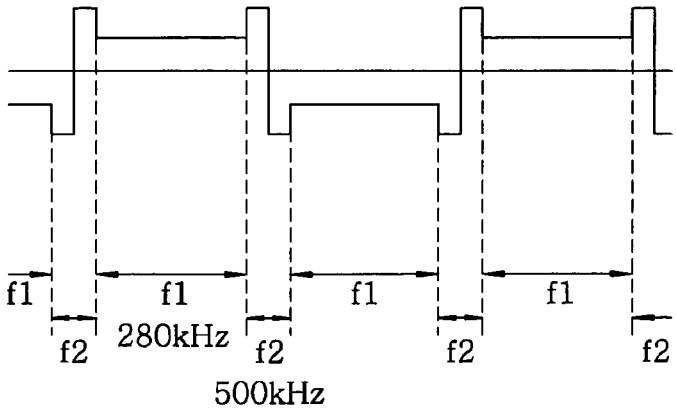

Specifically for example, while setting as 208 kHz the frequency of the control signal in the period T30 during which the power increasing signal is off, regardless of the elapsed time, the frequency of the control signal in the period during which the power increasing signal is on may vary between 300 kHz and 500 kHz depending on the elapsed time as shown in FIG. 39, thus varying the output power in the post and the pre-inversion period TI1 and TI2. For example, at the point where the elapsed time is 4 sec, the frequency f2 of the control signal from the onset of the pre-inversion period TI2 to the end point of the post-inversion period TI1 is set as 300 kHz as shown in FIG. 40A. Also, at the point where the elapsed time is 50 sec, the frequency f2 of the control signal in this period is set as 500 kHz as shown in FIG. 40B, and the frequency f1 of the control signal in period T30 is 280 kHz regardless of the elapsed time.

Figure 41:
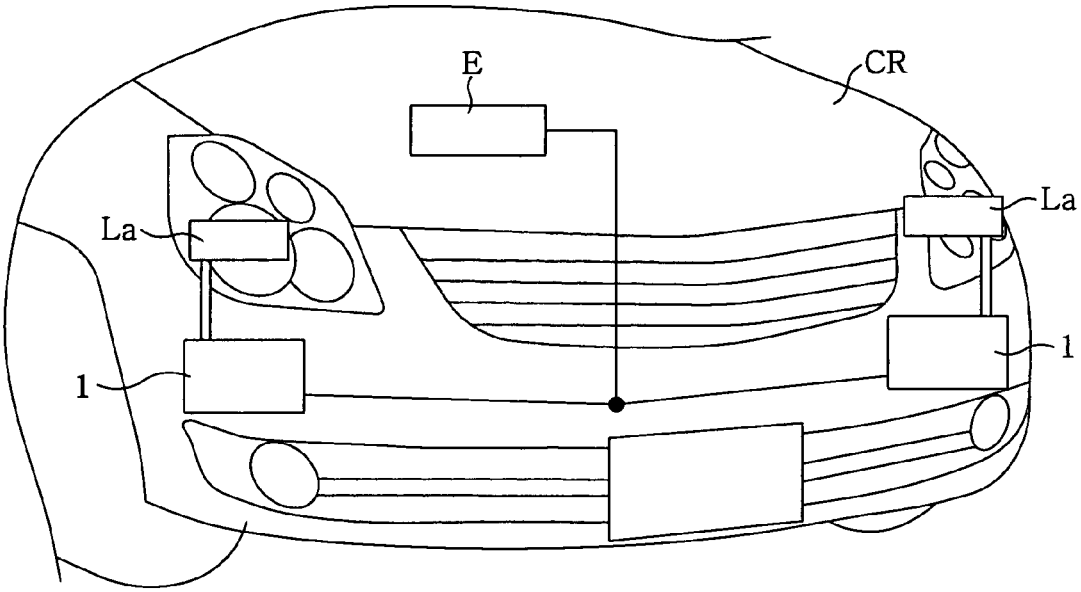
FIG. 41 is an explanatory view of an example in which the embodiments of the invention are used.

The discharge lamp lighting devices 1 described above and the discharge lamp La used for headlight of vehicles may be employed as in a headlight device, and may be mounted on the vehicle CR as shown in FIG. 41. In this case, a battery mounted in the vehicle CR is used as the DC power source E.

While the invention has been shown and described with respect to the embodiments, it will be understood by those skilled in the art that various changes and modification may be made without departing from the scope of the invention as defined in the following claims.

What is claimed is:

1. A discharge lamp lighting device, comprising:

a DC power source for outputting a DC output power;

an inverter for inverting the DC power outputted from the DC power source at a predetermined inversion time interval to supply a square wave AC power to a discharge lamp; and a controller for controlling the output power from the DC power source, wherein the controller performs a synchronous operation for temporarily increasing the output power from the DC power source in an output temporarily increasing period existing immediately before and/or immediately after every inversion operation of the inverter, wherein the controller controls the DC power source such that DC power outputted during a period other than the output temporarily increasing period in a power increasing period is greater than the DC output power outputted during the period other than the output temporarily increasing period in a rated power period, the rated power period being a period during which a rated power is supplied to the discharge lamp and the power increasing period being a period from start-up of the discharge lamp to an onset of the rated power period, and wherein the controller controls the DC power source such that at least one of an increment of the output power for the output temporarily increasing period and a length of the output temporarily increasing period is less in at least a part of the output increasing period than in the rated power period.

2. The discharge lamp lighting device of claim 1, wherein the controller detects an output voltage and an output current from the DC power source and control a predetermined target power value by the detected output voltage to obtain a target current value, and controls the DC power source such that the detected output current is coincided with the target current value during the period other than the output temporarily increasing period, while the detected output current is coincided with a sum of the target current value and a predetermined increment during the output temporarily increasing period, the increment in at least a part of the output increasing period being smaller than that of the rated power period.

3. The discharge lamp lighting device of claim 1, wherein the controller detects an output voltage and an output current from the DC power source and control a predetermined target power value by the detected output voltage to obtain a target current value, and controls the DC power source such that the detected output current is coincided with the target current value during the period other than the output temporarily increasing period, while the detected output current is coincided with a multiplication of the target current value and a predetermined multiplication factor not less than 1 during the output temporarily increasing period, the multiplication factor in at least a part of the output increasing period being smaller than that of the rated power period.

4. The discharge lamp lighting device of the claim 1, wherein the controller makes the length of the output temporarily increasing period smaller than that of the rated power period in at least a part of the output increasing period.

5. The discharge lamp lighting device of claim 1, wherein the controller makes the output power from the DC power source constant in at least a part of the output increasing period, without performing the synchronous operation.

6. The discharge lamp lighting device of claim 1, wherein, in the output increasing period, the controller gradually decreases the output power from the DC power source to the rated power during the period other than the output temporarily increasing period, and gradually increases the increment of the output power of the DC power source during the output temporarily increasing period.

7. The discharge lamp lighting device of claim 1, wherein the controller detects an output voltage from the DC power source, and an increment of the output power from the DC power source for the output temporarily increasing period is set smaller as the detected output voltage is lower.

8. The discharge lamp lighting device of claim 1, wherein the controller detects an output current from the DC power source, and an increment of the output power from the DC power source is set smaller during the output temporarily increasing period is set smaller as the detected output current is higher.

9. The discharge lamp lighting device of claim 1, wherein the controller gradually increases, during a predetermined period at the start-up of the discharge lamp, an increment of the output power from the DC power source during the output temporarily increasing period.

10. The discharge lamp lighting device of claim 1, wherein the device further comprises a temperature estimation unit for estimating temperature of the discharge lamp and generating an output depending on the estimated temperature, and wherein the controller makes the output increasing period as an estimated temperature that is estimated by the temperature estimation unit is higher onset of the output increasing period.

11. The discharge lamp lighting device of claim 1, wherein, in an post-inversion period immediately after the inverter ends the polarity inversion of the DC power, the output power from the DC power source is further increased from that of the rated power period where the output power from the DC power stays constant, during a period from the end of the post-inversion period to the start of a pre-inversion period, and wherein both the post-inversion period and the pre-inversion period are set to be shorter than a half of the inversion time period.

12. The discharge lamp lighting device of claim 11, wherein the output voltage of the DC power source increases linearly, from the end of the rated power period to the end of the pre-inversion period or post-inversion period.

13. The discharge lamp lighting device of claim 12, wherein the output voltage from the DC power source decreases continuously or nonlinearly from the start of the post-inversion period to the start of the rated power period.

14. The discharge lamp lighting device of claim 12, wherein, for each rated power period, a peak value of the output power from the DC power source in the pre-inversion period right after the rated power period is not less than that of the output power from the DC power source in the post-inversion period right before the rated power period.

15. A headlight device, comprising a discharge lamp lighting device of claim 1, and a discharge lamp lighted by the discharge lamp lighting device.

16. A vehicle, comprising the headlight device of claim 15.

* * * * *